US005423389A

United States Patent [19]

Warren et al.

[11] Patent Number: 5,423,389

[45] Date of Patent: Jun. 13, 1995

[54] CURVED DRILLING APPARATUS

[75] Inventors: Tommy M. Warren, Coweta; Houston B. Mount, Tulsa, both of Okla.

[73] Assignee: Amoco Corporation, Chicago, Ill.

[21] Appl. No.: 218,228

[22] Filed: Mar. 25, 1994

[51] Int. Cl.[6] ..... E21B 7/08

[52] U.S. Cl. ..... 175/75; 175/76

[58] Field of Search ..... 175/61, 73, 74, 75, 175/76, 320

[56] References Cited

U.S. PATENT DOCUMENTS

| | | | |
|---|---|---|---|
| 4,262,758 | 4/1981 | Evans | 175/73 |
| 4,739,841 | 4/1988 | Das | 175/61 |
| 4,895,214 | 1/1990 | Schoeffler | 175/76 X |
| 5,213,168 | 5/1993 | Warren et al. | 175/61 |
| 5,265,687 | 11/1993 | Gray | 175/73 X |

OTHER PUBLICATIONS

T. M. Warren et al., "Short-Radius Lateral Drilling System", Orally presented Oct. 1992; Published Feb. 1993; p. 111 ff.

W. J. Winters et al., "Field Tests of a Low-Cost Lateral Drilling Tool," Presented Feb. 1993; pp. 2-7.

*Primary Examiner*—William P. Neuder

*Attorney, Agent, or Firm*—James A. Gabala; Richard A. Kretchmer

[57] ABSTRACT

A rotary drill bit for drilling a curved subterranean borehole. In one embodiment, the drill bit comprises a side portion, a plurality of cutting elements that produce a lateral force on the drill bit in response to the rotation of the drill bit in the borehole, and bearing means. The bearing means is located on the side portion of the drill bit and contacts the borehole wall during drilling to receive a reactive force that is from the borehole, that is in response to the lateral force and that is directed to a location adjacent to the uphole end of the side portion of the drill bit. The reactive force and the lateral force form a downhole-moment that is about the drill bit and that is opposed by an uphole-moment having a force component that is directed at the flexible joint. The uphole end of the bearing means is located relatively close to the cutting elements such that the magnitude of the downhole-moment and the magnitude of the uphole-moment are minimized.

29 Claims, 8 Drawing Sheets

32
28
85
84
186
20
22
28
85
84
186
20
22
28
84
186
20
22

CURVED DRILLING APPARATUS

TECHNICAL FIELD

This invention relates to the general subject of oil well and gas well drilling and, in particular, to apparatus and methods used to drill a curved wellbore in the surface of the earth.

BACKGROUND OF THE INVENTION

Lateral wellbores, or "laterals", offer the potential to drain more oil than would be recovered otherwise. For example, laterals may be used to tap fresh oil by intersecting fractures, penetrating pay discontinuities, and draining up-dip traps. Lateral recompletions can also correct production problems such as water coning, gas coning, and excessive water cuts from hydraulic fractures which extend below the oil-water interface. Moreover, synergistic benefits may result from coupling lateral recompletions with enhanced recovery techniques to solve conformance problems, to contact unswept oil by recompleting injection wells, and to redirect sweep by converting existing well patterns into line-drive configurations. Finally lateral recompletion strategies can take advantage of current production infrastructure, capital resources of existing wellbores, known resources of oil in place, and secondary and tertiary recovery technology.

One major impediment to the widespread use of lateral re-entries is that the cost of drilling and completing laterals should be kept as low as possible. Workover economics in mature fields require substantial cost reductions over the methods most often used for drilling new horizontal wells. Thus, there is a great need for a reliable reduced-cost drilling system that utilizes the equipment and cost structures of workover and repair services.

In addition, to the economic constraints, there are technical limitations. For a curve drilling system to be technically successful it should preferably drill a consistent radius of curvature and drill the curve in the desired direction. This is because it is highly desireable to:

- Position the end of the drilling assembly within a precise depth interval so the lateral can traverse the pay zone as desired.
- Place the lateral in a direction dictated by well spacing, desired sweep pattern, or other geological considerations.
- Establish a smooth wellbore to facilitate drilling the lateral and completing the well.

Rotary-steerable drilling systems are one category of curve drilling systems. The downhole components of such systems often include a curve assembly, flexible drill collars, and orientation equipment. The curve assembly is relatively short and incorporates a flexible joint that is pushed to one side of the wellbore to tilt the drill bit. Orientation equipment typically comprises a standard mule-shoe sub for magnetic orientation. This basic system concept has been around for decades; however problems with angle build and directional control have limited its commercial success.

U.S. Pat. No. 5,213,168 to Warren et. al. (assigned to Amoco Corporation) describes an improved curved drilling assembly. Consistent performance was achieved, in part, by stabilizing the drill bit to continually point along a curved path and designing the bit so that it cuts only in the direction it is pointed. In particular, improved bit stability was achieved by using a "low-friction gauge" technique. (See, for example, U.S. Pat. Nos. 5,010,789 and 5,042,596 to Brett et. al. and assigned to Amoco Corporation). The drill bit cutters are positioned so that they direct a lateral force toward a smooth pad on the side or gauge portion of the drill bit. The pad contacts the borehole wall and transmits a restoring force to the drill bit. This force rotates with the bit and continually pushes one side of the drill bit (i.e., the one that does not have a gauge cutting structure) against the borehole wall. When such a drill bit is used, the curve drilling assembly drills a curved path by continually pointing the drill bit along a line that is tangent to the curved path. The assembly runs smoothly, the hole is uniform in diameter, and the effects of varying lithology are negated. Moreover, the cost to manufacture such an assembly, including the anti-whirl drill bit, is much less than that for a curve drilling assembly that uses a mud motor.

When the drill bit rotates about its center in a gauge-hole, the off-center position of the flexible joint causes the drill bit axis to be tilted with respect to the borehole centerline everywhere except at the bit face. At the bit face, the centerline of the drill bit is pointed along a tangent to the curve centerline. If the curvature of the hole is perturbed and becomes less than the desired curvature, the drill bit axis will point above the borehole inclination and will thus tend to increase the curvature. If the curvature becomes greater than that which is desired, the opposite occurs. Thus, stable equilibrium results when the bit face centerline and hole inclination are aligned. Moreover, as the bit drills ahead along a curved path, the inclination of the bit continually changes so that it is always inclined in a direction that keeps the borehole along the desired curved path without requiring the bit to cut sideways.

Although the drilling system of U.S. Pat. No. 5,213,168 has many advantages over the prior art, experience has shown that there is still room for improvement.

SUMMARY OF THE INVENTION

A general object of the invention is to provide improved short radius and long radius lateral drilling systems.

One particular object of the invention is to provide a curved drilling assembly having an improved ball joint or flexible joint.

Another object of the invention is to provide a curved drilling assembly that is more robust.

Still another object of the invention is to provide an improved curved drilling assembly that incorporates a conventional drill bit.

Yet another object of the invention is to provide a low-cost, short radius lateral drilling system that includes a bi-center anti-whirl drill bit.

Another specific object of the invention is to provide an improved drill bit for use in a curved drilling assembly.

In accordance with one embodiment of the present invention, an improved drill bit for a curve drilling assembly is provided. The curve drilling assembly is connectable to a rotary drill string for drilling a curved subterranean borehole having a bottom, having a wall, having an inside radius and having an outside radius. The assembly comprises curve guide means connectable with the drill string for guiding the drill string through a curved path, the improved rotary drill bit, and a flexible joint located intermediate the ends of the drill string and at a predetermined distance from the drill bit. The improved drill bit has: a base portion disposed about a longitudinal bit axis for connecting to the downhole end of the drill string; a side portion that is disposed about the longitudinal bit axis, that extends from the base portion, that has an uphole end and that has a downhole end; a face portion disposed about the longitudinal bit axis and extending from the side portion; and a plurality of cutting elements that are carded by the drill bit and that produce a lateral force on the drill bit at the downhole end of the drill bit in response to the rotation of the drill bit in the borehole. In particular, the improved drill bit carries on its side portion bearing means for substantially continuously contacting the borehole wall during drilling and for receiving a reactive force that is from the borehole, that is in response to the lateral force on the drill bit and that is directed to a location adjacent to the uphole end of the side portion of the drill bit. The reactive force and the lateral force form a downhole-moment that is about the drill bit and that is opposed by an uphole-moment having a force component that is directed at the flexible joint. The uphole end of the bearing means is located at a predetermined axial distance from the face of the drill bit such that the magnitude of the downhole-moment and the magnitude of the uphole-moment are lower than the magnitude of the downhole-moment and the magnitude of the uphole-moment which would be present if the bearing means were located at an axial distance that is greater than the predetermined axial distance.

In one particular embodiment of the invention, the cutting elements of the drill bit comprise two sets of cutting elements. One set of cutting elements is located adjacent to the downhole end of the side portion of the drill bit, and a second set of cutting elements is located adjacent to the uphole end of the side portion of the drill bit, wherein the first set of cutting elements is located at a radial distance from the longitudinal bit axis that is less than the radial distance that the second set of cutting elements is located from the longitudinal bit axis.

In another embodiment of the invention, a reaming sub is used to connect the base portion of a standard drill bit to the remainder of the curved drilling assembly. The sub has a downhole end and a uphole end and carries a reaction member at its downhole end and reaming means at its uphole end. The reaction member substantially continuously contacts a portion of the borehole wall during drilling and receives the reactive force that is from the borehole and that is in response to the lateral force from the cutting elements. The reaction member extends radially from the longitudinal bit axis by no more than the bore cut by the cutting elements. The reaming means enlargingly opens the bore cut by the cutting elements and is located angularly in advance of the reaction member by a maximum of 180 degrees.

The many advantages and features of the present invention will become readily apparent from the following detailed description of the invention, the embodiments described therein, from the claims, and from the accompanying drawings.

DETAILED DESCRIPTION

Figure 1A:
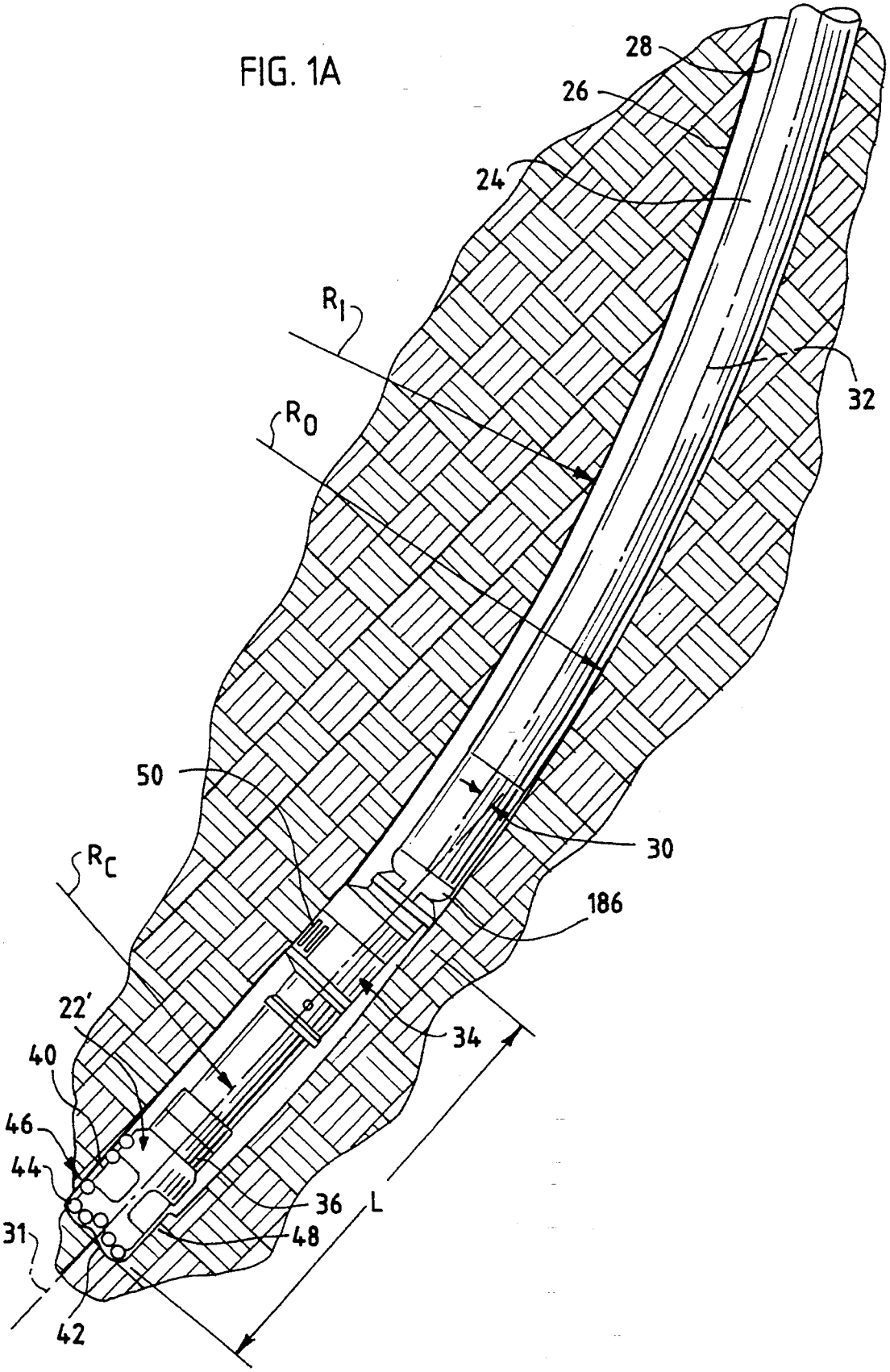
FIG. 1A is a schematic diagram of one embodiment of a curved drilling assembly that is the subject of the present invention and that is adapted for use in drilling curved boreholes having a long radius of curvature.

While this invention is susceptible of embodiment in many different forms, there is shown in the drawings, and will herein be described in detail, several specific embodiments of the invention. It should be understood, however, that the present disclosure is to be considered an exemplification of the principles of the invention and is not intended to limit the invention to the specific embodiments illustrated.

Curved Drilling Assembly

Turning to FIG. 1A, a curved drilling assembly 20 is shown connected between a rotary drill bit 22 and the drill string 24 that is used in drilling a curved borehole 26 of an oil or gas well. The borehole 26 is characterized by an inside radius $R_i$, an outside radius $R_o$ and a radius of curvature $R_c$. The curve drilling assembly 20 is operated by a conventional rotational drive source (not shown in the drawings for purposes of simplicity and known to those skilled in the art) for drilling in subterranean earthen materials to create a borehole 26 having a borehole wall 28. The rotational drive source may comprise a commercially available drilling rig with a drill string for connection to commercially available subterranean drill bits. The assembly 20 may be used to drill a curved borehole 26 in virtually any type of environment, (e.g., water wells, steam wells, subterranean mining, etc.) The assembly 20 also may be used for initiating a curved borehole 26 from a substantially straight borehole.

The curve drilling assembly 20 includes: a curve guide means 34 connectable with the drill string 24; the drill bit 22; bearing means 48; and contact means or borehole engaging means 50.

In order to drill a curved borehole 26, it is necessary to initiate and maintain a deflection 30 of the drill bit axis 31 with respect to the longitudinal axis 32 of the borehole 26 and to control the azimuthal direction of the deflection in the borehole. A curve guide means 34 is used to initiate and maintain deflection 30 by deflecting the drill string 24 toward the outside radius $R_o$ of the borehole.

The drill bit 22 has a base portion 36, a gauge portion 40 extending from the base portion, a face portion 42 extending from the gauge portion, a plurality of cutting elements 44, and imbalance force means 46 for creating a net imbalance force along a net imbalance force vector $F_i$ (See FIG. 4) that is substantially perpendicular to the longitudinal drill bit axis 31 during drilling.

The bearing means 48 is located in the curve drilling assembly 20 near the cutting elements 44 for intersecting a force plane defined by the longitudinal bit axis 31 and the net imbalance force vector $F_i$ and for substantially continuously contacting the borehole wall 28 during drilling.

The borehole engaging means 50 is used to contact or engage the borehole wall 28 and to support a radial force component of the net imbalance force $F_i$ on the borehole wall 28 during drilling.

Figure 2:
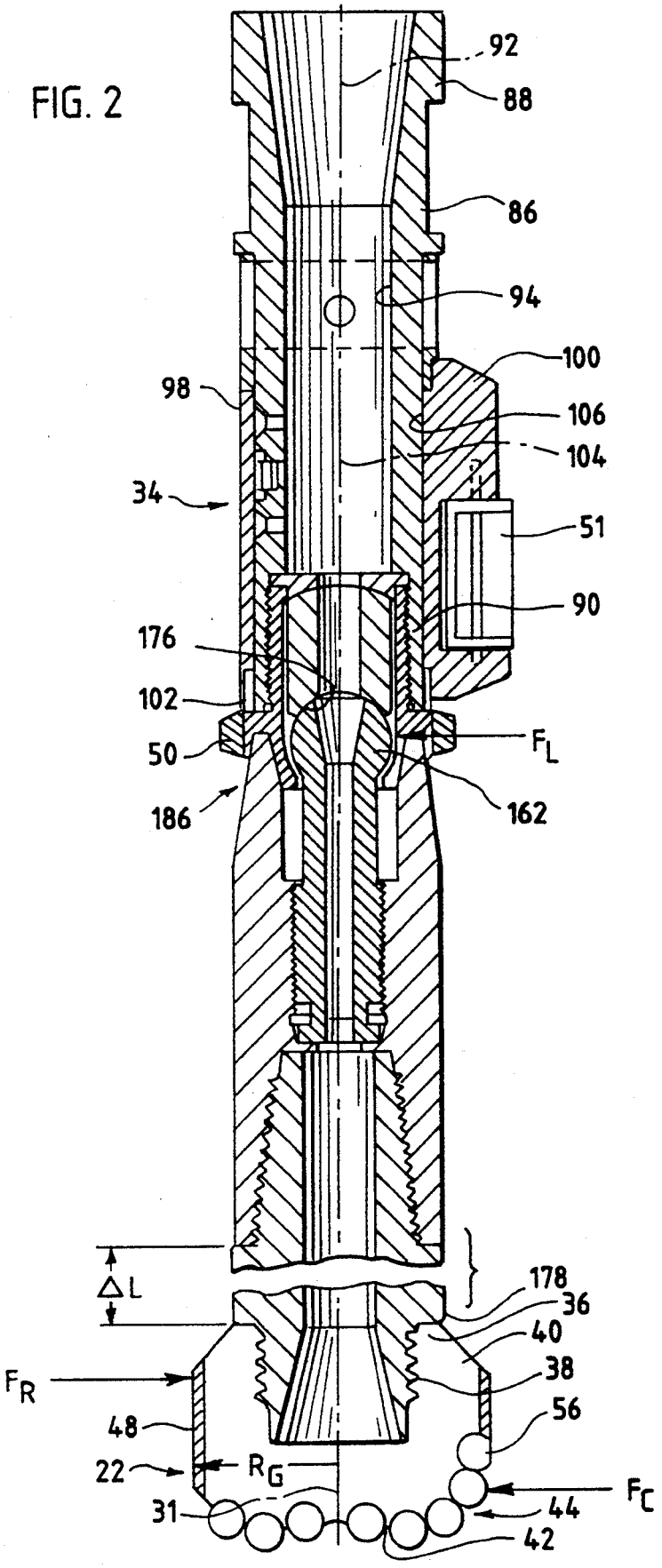
FIG. 2 is an enlarged sectional view of the lower end of a conventional curved drilling assembly similar to that shown in FIGS. 1A through 1D wherein the curved guide means is located above a flexible joint.

Referring to FIG. 2, the curve guide means 34 comprises a mandrel 86 rotatably disposed within a housing or eccentric sleeve 98, and a flexible or ball joint assembly 186. The mandrel 86 has an uphole end 88, a downhole end 90, a longitudinal or rotational axis 92, and an internal fluid passageway 94. The housing 98 has an uphole end 100, a downhole end 102, a longitudinal axis 104 (Also see FIGS. 5A and 5B), and a passageway 106 extending between the uphole end and the downhole end. This passageway 106 may extend through the housing 98 at an angle skewed with respect to the housing axis 104 in order to skew the rotational axis 92 of the mandrel 86 with respect to the housing axis. The housing 98 includes borehole engaging means 50 for preventing rotation of the housing with the mandrel 86 during drilling. Borehole engaging means 50 typically comprises spikes, blades, wire-like or brush-like members, or other friction creating devices which will engage with the borehole wall 28 to prevent rotation of the housing 98 when the drill bit 22, drill string 24, and the mandrel 86 are rotated (normally in a clockwise direction viewed from the top of the borehole 26) during drilling and which will permit rotation of the housing with the mandrel when the mandrel is rotated in the opposite direction (normally counterclockwise). (See U.S. Pat. No. 5,213,168 to Warren et. al. and assigned to Amoco Corporation).

The assembly 20 may be used in drilling curved boreholes having long, medium, and short radii of curvature. When drilling laterals the rate of inclination change is usually described in terms of the radius of the borehole $R_c$ (See FIG. 1A). This is different than in conventional drilling where curved boreholes are often described by the build or drop rate in degrees per 100 feet. A short radius curve is generally considered to be less than 150 feet. A "medium radius" is about 150 to 300 feet and a "long radius" curve is anything beyond 300 feet. For comparison, a 5 degree per 100 feet build is approximately equal to a 1,000 foot radius curve. None of the various curve rates (short, medium, long) am inherently better than the others. Depending on the objectives for a given well and the constraints of the situation, one curve rate will often be more suitable than another. However, as a general rule, short radius curves are often more desirable in recompletions where there is minimal open hole between the casing seat and the target zone. The shorter the radius, the less likely a section will need to be removed from the casing. Short radius curves also allow submersible pumps to be located close to pay zones. And the shorter the curve, the less formation above the target zone will need to be penetrated. This may minimize problems associated with having open hole exposed to unstable shales, gas caps, and other producing zones. As the radius of curve gets smaller, so does the length of the lateral which can be drilled. Small radius curves also restrict the types of completions which can be performed. For example, it would not be realistic to conventionally case a 30 foot radius curve.

The flexibility of the drill string 24 and the ability of the assembly 20 to drill a short radius curved borehole is enhanced by the addition of a flexible joint 186 between the ends of the drill string. The flexible joint 186 may be a knuckle joint, or other form of universal joint capable of creating a deflection 30 to increase the radius of curvature $R_c$ and transmitting torsional, thrust, and tensile forces through the deflection.

Another means or method for varying the radius of curvature $R_c$ of the curved borehole 26 is to vary the length L (See FIG. 1A) between the drill bit 22 and the flexible joint 186. This can be done by using one or more spacing members 178. Referring to FIG. 2, the curve drilling assembly 20 has a spacing member 178 which is detachably connectable between the drill bit 22 and the downhole end 90 of the mandrel 86. It provides a convenient means for varying the distance L between the drill bit 22 and the downhole end 90 of the mandrel without modifying the drill bit or the mandrel. The spacing member 178 can be designed to be relatively quickly and inexpensively manufactured in various lengths. This allows the other components, (i.e., the drill bit 22, mandrel 86, etc.,) which require more expensive and time-consuming manufacturing processes, to be made in uniform sizes rather than requiring expensive custom manufacturing.

Drill Bit

Figure 4:
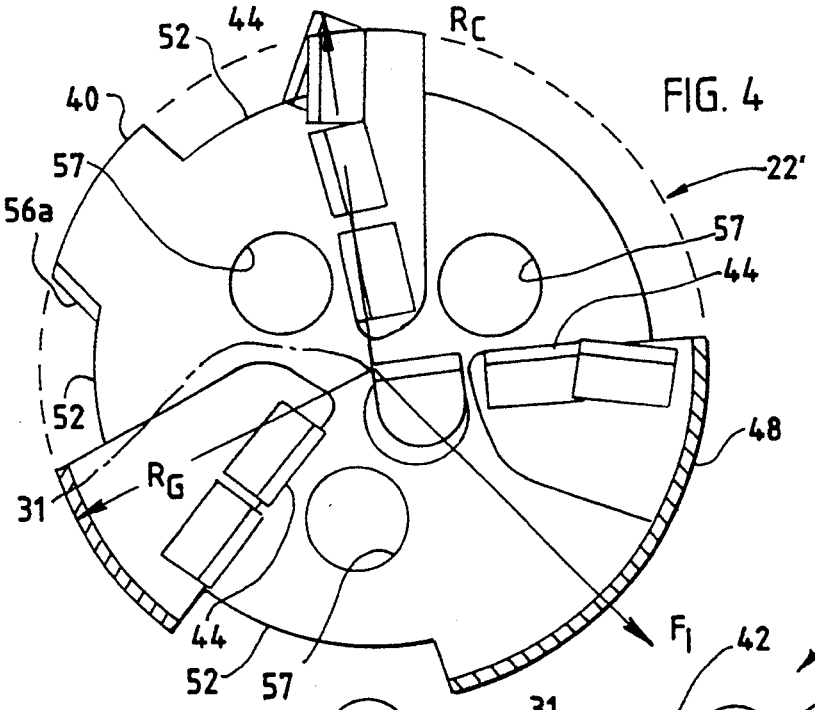
FIG. 4 is bottom end view of the drill bit of FIG. 3.
Figure 3:
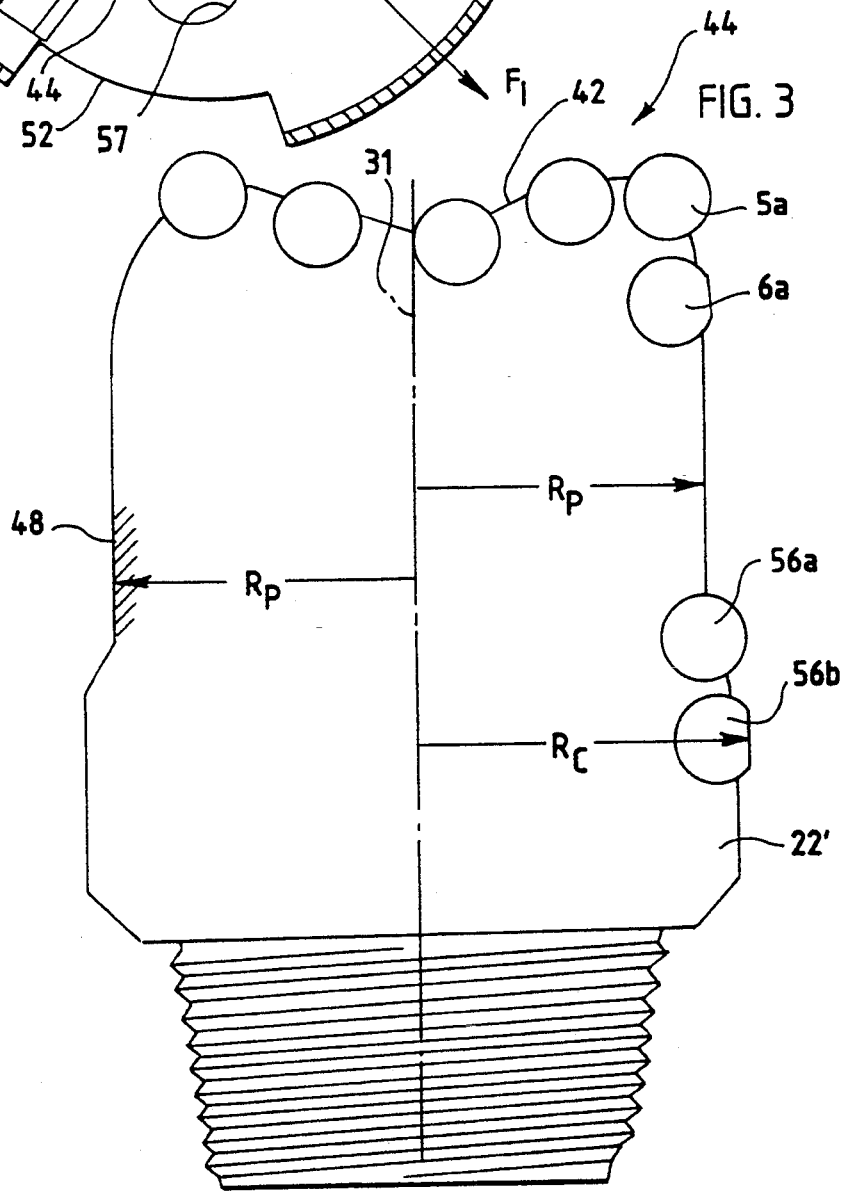
FIG. 3 is a schematic side view of the drill bit that is located at the end of the curved drilling assembly illustrated in FIG. 1A.

Returning to the drill bit 22, the base portion 36 of the drill bit is disposed about a longitudinal bit axis 31 for receiving the rotational drive source through the drill string 24 and the curve guide means 34. The base portion 36 includes a connection 38 (i.e., a box or pin type, see the lower end of FIG. 2 for one example) that can be joined in a known manner to other parts of the drill string 24. The longitudinal bit axis 31 extends through the center of the base portion 36 of the drill bit 22. "Radial", as the term is used herein, refers to positions located or measured perpendicularly outward from longitudinal bit axis 31, for example, as shown in FIGS. 3 and 4. "Lateral", as the term is used herein, refers to positions or directions located or measured transversely outwardly (i.e., sideways) from drill bit axis 31, although not necessarily perpendicularly outwardly from the drill bit axis 31. "Axial" or "longitudinal" refers to positions or directions located or measured along or coextensively with the drill bit axis 31.

The gauge portion 40 of the drill bit 22 is generally cylindrical in shape and has an axis which is substantially parallel to drill bit axis 31. Because of the substantially cylindrical shape of the gauge portion 40, the gauge portion has a gauge radius $R_g$ measured radially outward and perpendicularly from longitudinal drill bit axis 31 to the outside surface 48 of the gauge portion, as shown in FIG. 2. In other words, the gauge portion 40 meets the face portion 42 of the drill bit 22 along a circumferential line at which the radius of the drill bit $R_g$ is measured. The gauge portion 40 extends from the base portion 36 and preferably includes a plurality of exterior grooves 52 or channels 57 (See FIG. 4) that extend generally parallel to drill bit axis 31 to facilitate the removal of rock cuttings, drilling mud, and debris from the bottom of the borehole 26.

The face portion 42 of the drill bit 22 has a curved profile (i.e., the cross-section of face portion, when viewed from a side-view perpendicular to the drill bit axis 31, has a concave profile). The face portion 42, when viewed from the side-view perspective, may, for example, have a spherical, parabolic, or other curved shape (See FIGS. 2 and 3). Such profiles, however, are not limiting. For example, the face portion 42 may be flat or may have an axially extending cavity for producing core samples.

The cutting elements 44 of the drill bit 22 are fixedly disposed on, project from the exterior of the drill bit, and spaced apart from one another. Preferably, the drill bit 22 includes at least one gauge-cutting element 56, that is spaced from the cutting elements 44 on the face portion 42 of the drill bit, that is fixedly disposed on the gauge portion 40, and that projects from the gauge portion.

Each of the cutting elements preferably comprises a poly-crystalline diamond (PCD) compact material mounted on a support, such as a carbide support (See FIG. 4). The cutting elements may, of course, include other materials such as natural diamond and thermally stable polycrystalline diamond material. Each of the cutting elements 44 and 56 has a base disposed in the face portion 42 or the gauge portion 40, respectively of the drill bit body. Each of the cutting elements 44 and 56 has a cutting edge, for contacting the subterranean earthen materials to be cut.

The curve drilling assembly 20 preferably includes means 46 for creating a net imbalance force $F_i$ along a net imbalance force vector that is substantially perpendicular to the longitudinal bit axis 31 during drilling. Before proceeding it is appropriate to state the preferred components and properties of the imbalance force means 46, the various forces acting on a drill bit 22 during drilling and how they are created, and how these forces are managed in a curve drilling assembly 20.

The imbalance force means 46 may be provided by a mass imbalance in the drill bit 22 or drill string 24, an eccentric sleeve or collar placed around the drill bit or drill string, or a similar mechanism capable of creating a net imbalance force vector $F_i$. Preferably, the imbalance force means 46 is produced by the cutters 44 and 56 and comprises a radial imbalance force and a circumferential imbalance force. In other words, the net imbalance force vector $F_i$ can be viewed as the combination or the resultant of a radial imbalance force vector and a circumferential imbalance force vector.

When produced by the cutting elements 44 and 56, the magnitude and direction of net imbalance force vector $F_i$ will depend on the positioning and orientation of the cutting elements (e.g., the specific arrangement of cutting elements 44 and 56 on drill bit 22, and the shape of the drill bit since the shape influences positioning of the cutting elements). Orientation includes backrake and siderake of the cutting elements. The magnitude and direction of force vector $F_i$ is also influenced by the specific design (e.g., shape, size, etc.) of the individual cutting elements 44 and 56, the weight-on-bit lead applied to the drill bit 22, the speed of rotation, and the physical properties of the subterranean earthen material being drilled. The weight-on-bit lead is a longitudinal or axial force applied by the rotational drive source (i.e., drill string) that is directed toward the face portion 42 of the bit 22. Subterranean drill bits are often subject to weight-on-bit loads of 10,000 lbs. or more.

In any case, the cutting elements 44 and 56 are located and positioned to cause net imbalance force vector $F_i$ to substantially maintain the bearing surface 48 in contact with the borehole wall 28 during the drilling, to cause not radial imbalance force vector to have an equilibrium direction, and to cause net radial imbalance force vector to return substantially to the equilibrium direction in response to a disturbing displacement. These aspects of the invention and the related forces on the drill bit are discussed in U.S. Pat. Nos. 5,213,168; 5,131,478; 5,010,789; and 5,042,596—all assigned to Amoco Corporation.

As shown in FIG. 4, the cutting elements are positioned in linear patterns along the radial dimension on the face portion. This is by way of illustration, however, and not by way of limitation. For example, cutting elements may be positioned in a nonlinear pattern along a radial dimension of the face portion to form one or more curved patterns (not illustrated) or they may be positioned in a nonuniform, random pattern on the face portion (not illustrated). All of the cutting elements serve to produce a net imbalance force vector $F_i$ that is located substantially perpendicular to the longitudinal bit axis 31 during drilling.

Referring to FIGS. 3 and 4, the bearing means or sliding surface 48 is located near the drill bit cutting elements for intersecting a force plane that is defined by the net imbalance force vector $F_i$ and the longitudinal bit axis 31. The bearing surface 48 is preferably located on or adjacent to the drill bit 22 (e.g., on a drill collar or on a stabilizer that is positioned next to the drill bit, as would be understood by one skilled in the art in view of disclosure contained herein). Preferably, the bearing surface 48 is located within a substantially continuous cutting element devoid region on the gauge portion 40 of the drill bit 22. Preferably, the cutting element devoid region extends onto the face portion 42 of the drill bit 22.

The cutting element devoid region comprises a substantially continuous region of the gauge portion 40 and the face portion 42 that is devoid of cutting elements 44 and 56 and abrasive surfaces. The cutting element devoid region intersects and is disposed about the force plane defined by the longitudinal bit axis 31 and net imbalance force vector $F_i$. The force plane is a concept that is useful for reference purposes and in explaining the effect of the net imbalance force vector $F_i$ on the drill bit 22 and the curve drilling assembly 20. For example, the force plane lies in the plane of the drawing sheet of FIG. 3 and extends outwardly from longitudinal bit axis 31 through the bearing surface 48. When the drill bit 22 is viewed longitudinally as shown in FIG. 4, this force plane emerges perpendicularly from the drawing sheet with its projection corresponding to net imbalance force vector $F_i$. The force plane concept aids in understanding the effect of the net imbalance force vector $F_i$ because net imbalance force vector may not always intersect gauge portion 40. In some instances, for example, the force vector $F_i$ may extend outward radially from bit axis 31 at or near face portion 42 directly toward the borehole wall 28 without passing through gauge portion 40. Even in these instances, however, the net imbalance force $F_i$ will be directed and lie in a radial plane of the drill bit 22 which passes through the gauge portion 40.

The bearing surface 48 is disposed in the cutting element devoid region about the force plane for substantially continuously contacting the borehole wall 28 during the drilling. The bearing surface 48 may comprise one or more rollers, ball bearings, or other low friction load bearing surfaces. Preferably, the bearing surface 48 comprises a substantially smooth, wear-resistant sliding surface 48 disposed in the cutting element devoid region about the force plane for slidably contacting the borehole wall 28 during the drilling. The preferred sliding surface 48 intersects the force plane formed by the longitudinal bit axis 31 and the net imbalance force vector $F_i$.

The sliding or bearing surface 48 constitutes a substantially continuous region that has a size equal to or smaller than cutting element devoid region. Here the bearing surface 48 is disposed on gauge portion 40. The bearing surface 48 may comprise the same material as other portions of drill bit 22, or a relatively harder material such as a carbide material. In addition, the bearing surface 48 may include a wear-resistant coating or diamond impregnation, a plurality of diamond stud inserts, a plurality of thin diamond pads, or similar inserts or impregnation that strengthen the bearing surface and improve its durability.

The bearing surface 48 directly contacts the borehole wall 28. Drilling mud is pumped through the drill bit and circulates up the borehole past the gauge portion of the drill bit 22, thereby providing some lubrication for the bearing surface 48. Nonetheless, substantial contact of the bearing surface 48 with the borehole wall 28 does occur. Accordingly, low friction, wear-resistant coatings for the bearing surface, as discussed above, are often desirable.

The specific size and configuration of bearing surface 48 will depend on the specific drill bit design and application. Preferably, the bearing means or sliding surface 48 extends along substantially the entire longitudinal length of gauge portion 40 and extends circumferentially around no more than approximately 50% of the gauge circumference. The sliding surface 48 may extend around about 20% to 50% of the gauge circumference. Preferably, the sliding surface or bearing means 48 extends around a minimum of about 30% of the gauge circumference.

The preferred sliding surface 48 is of sufficient surface area so that, as the sliding surface is forced against the borehole wall 28, the applied force will be significantly less than the compressive strength of the subterranean earthen materials of the borehole wall. This keeps the sliding surface 48 from digging into and crushing the borehole wall 28, which would result in the creation of an undesired bit whirling motion and overgauging of the borehole 26. The sliding surface 48 has a size sufficient to encompass net imbalance force vector $F_i$ as it moves in response to changes in hardness of the subterranean earthen materials and to other disturbing forces within the borehole 26. Preferably, the size of the sliding surface 48 is also selected so that the net imbalance force vector $F_i$ remains encompassed by the sliding surface as the drill bit cutters wear.

Flexible Drill Collars

Figures 1B, 1C, 1D:
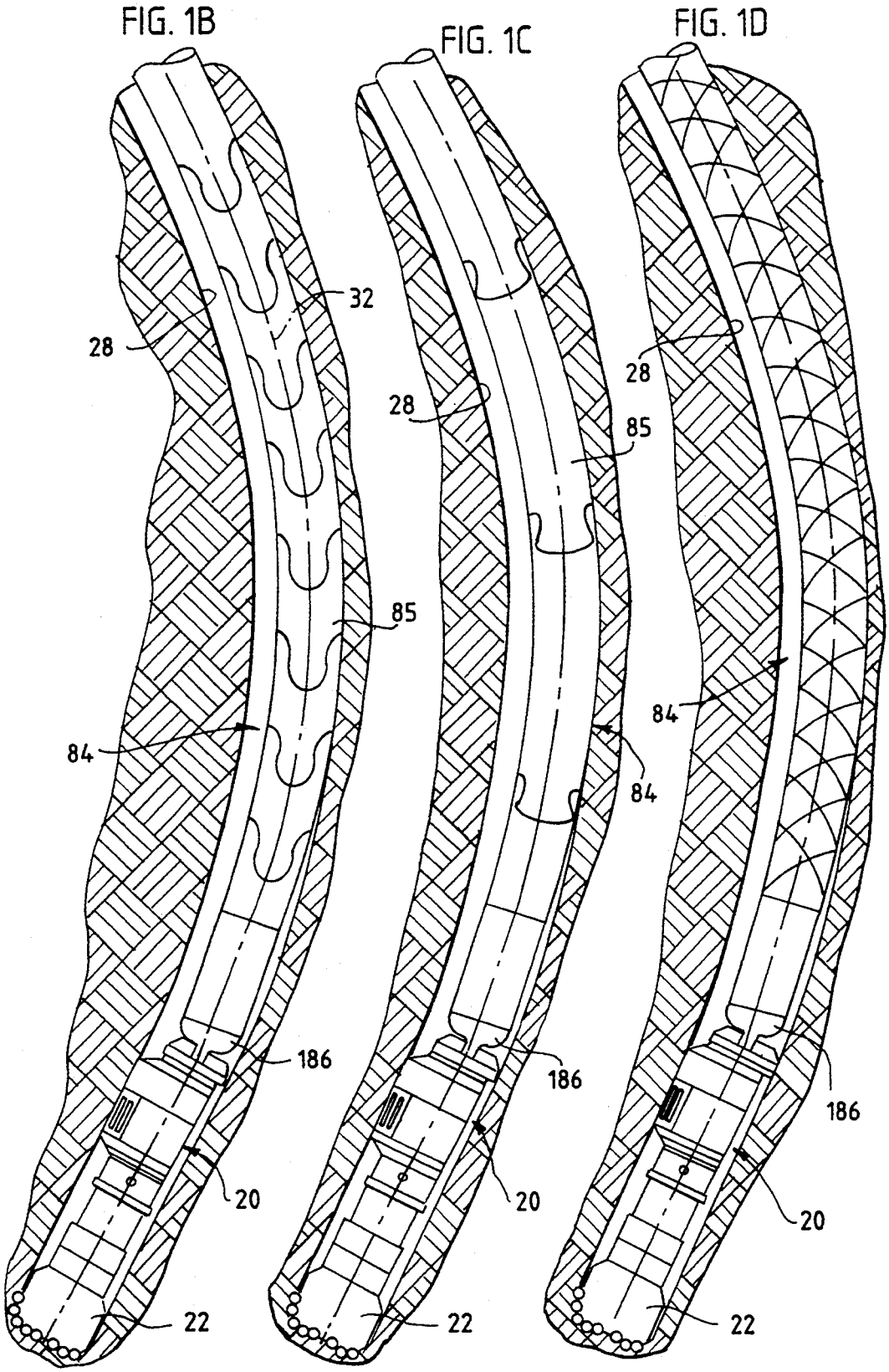
FIGS. 1B, 1C, 1D and 1E are partial schematic diagrams of other embodiments of curved drilling assemblies that are the subject of the present invention and that are adapted for use in drilling curved boreholes having a short radius of curvature.

Referring to FIG. 1B, the preferred modification for drilling a curved borehole having a short radius of curvature includes the addition of a flexible or an articulating drill pipe section 84 of drill string immediately above the curve drilling assembly 20. The articulating section 84 typically comprises sections of pipe having articulating joints 85, or the like, as would be known to one skilled in the art. The articulating section 84 is provided so that the drill string 24 does not impair the ability of the assembly 20 to drill a short radius curved borehole, (i.e., a conventional drill string often does not have sufficient flexibility to traverse the short radius curved borehole and therefore may not allow the assembly to drill a short radius curved borehole). The articulating section 84 preferably extends uphole from the curve drilling assembly 20 through the curved portion of the borehole.

Articulated drill collars are commonly called "wiggly pipe". They are constructed by cutting a series of interlocking lobed patterns through the wall of steel drill collars. Each such collar 84 is fitted with a high pressure hydraulic hose and seal assembly. Historically, these collars have been the only reasonable option for rotating through a short radius curve, but they are not ideal because they attempt to straighten under compressive loading, cause the drillstring to rotate rough, complicate the procedure for orienting the deflection sleeve and are difficult to handle. Steel collars are very strong when designed and manufactured properly and they can provide good service life, but they have serious problems. Moreover, wiggly pipe, however made, is somewhat difficult to handle because it cannot be stood up in a drilling derrick. This results in additional pick-up and lay-down time while drilling and tripping. Because a hydraulic liner must be installed to allow circulation of drilling fluid, this limits the size of survey instruments that can be run through the drillstring. It also limits the pressure rating of the system.

Rough drilling often occurs with wiggly pipe because of large variations in the flexibility of each cut as it is deflected and rotated through a full revolution. The collective effect of 60 to 100 cuts rotating in a 30 foot radius curve can produce major torque oscillations. Offsetting or "phasing" the cuts down the length of the pipe can reduce this problem, but some offsets actually exaggerate the effect.

Orientation problems often occur due to "slop" in the cuts. Wiggly pipe derives it's flexibility from the gaps or kerfs produced by the cutting torch in the manufacturing process, but this same feature allows each cut to slide and displace relative to the other cuts, particularly when the pipe is deflected in a curve. The additive "slop" of 60 to 100 cuts in a curve can produce large twist discontinuities leading to severe orientation errors.

Improved Flexible Drill Collars

One alternative to wiggly pipe is to use continuous tubulars constructed of high strength, low modulus materials such as titanium or graphite-fiberglass composites (See FIG. 1D). These materials can provide adequate strength without developing the severe stresses that often occurs in more conventional materials like steel or aluminum.

Most metal components should not be operated at cyclical loads greater than 50% of their yield strength because of the acceleration of fatigue crack growth by corrosion and surface irregularities (notches). Because of this, only titanium appears to provide adequate fatigue resistance for use in a short radius drilling. On the other hand, composite materials are more resistant to fatigue crack growth and are less expensive. Thus, even though the titanium has slightly lower stress levels than the a composite, a composite may actually provide a better fatigue life.

Composite drill pipe 84 (See FIG. 1D) is an alternative to wiggly pipe. Composite pipe has wear pads spaced along the pipe body to prevent full contact with the wellbore. Optimal pad spacing can be determined through finite element analysis. Lighter-weight, non-articulated composite pipe is much easier to handle than wiggly pipe. Drilling is smoother, weight and torque transmission are improved as (evidenced by higher penetration rates), and orientation is more accurate. Moreover, composite pipe is easier to use.

It was clear from tests with composite pipe that curve drilling can be an efficient and accurate process in the absence of undesirable articulated collar behavior. This led to a study to see if wiggly pipe could be redesigned to approach the behavior of composite pipe. An apparatus was built to analyze dynamic wiggly pipe behavior. It consisted of a 22 foot length of 4.5 inch casing bent to a curvature of 2 degrees/ft. (i.e., 28′ radius), thereby simulating a 3.94″ wellbore in which the wiggly pipe could be deflected and rotated. The device provided simultaneous rotation and axial loading of the wiggly pipe with an electric motor and a hydraulic jack. Windows were cut in the casing to allow direct observation of the articulated cuts. Hydraulic pressure, weight-on-bit and motor current (torque) were recorded on a strip chart which was later digitized for data analysis. The results showed:

- Variations in cut flexibility over one full rotation cause cyclical extension of the pipe (i.e., the pipe gets shorter and longer).
- Rounded surfaces on the leading edges of the cuts allow the driving lobes to "ride-up" the driven lobes when torque is applied, which further contributes to pipe elongation.
- Once torque is removed (by turning off the drilling platform motor), the pipe relaxes and axial lead decreases dramatically.

Work with small plastic pipe models showed that the ideal wiggly pipe should be designed to make a smooth axial lead transition from lobe to lobe and, if possible, the torque should be simultaneously transmitted from both driving lobes to both driven lobes. Also, the ability to center consistently when placed in tension would be a considerable benefit for orientation purposes.

Experimentation showed that patterns with curved surfaces could not meet the torque transmission criterion. However, patterns with square edges met the torque criterion by allowing both driving lobes to simultaneously transmit torque. Also, the flat lobe top and leading edges provided smooth axial load transfer.

A true Dovetail cut was tried based on its centering traits and desirable flat lobe edges (See FIG. 1C). A 20 foot joint with zero phasing gave encouraging results, but it was evident that the cuts should be phased to make the articulated collar run smoother. Rather than off-setting only a few degrees per cut as in prior practice, the pattern was repeated more frequently to reduce propagation of lateral deflection. The improvement was dramatic, with virtually smooth rotation at all axial loads. Wiggly pipe behavior had been substantially improved by the dovetail design.

The dovetail design has made wiggly pipe a viable option for short radius curve drilling and is highly recommended. However, in order to achieve future goals with the system, such as longer length laterals, the potential advantages of composite pipe may supercede the lower cost of steel wiggly pipe.

Improved Spacing Member

Earlier it was noted that one means or method of varying the radius of curvature $R_c$ of the curved borehole 26 is to vary the length L of the spacing member or members 178 (See FIG. 1A ) between the drill bit 22 and the downhole end 90 of the mandrel 86. The spacing member 178 is detachably connectable between the drill bit 22 and the downhole end 90 of the mandrel 86. Often while drilling a horizontal section of a well, a correction to the inclination or the drection has to be made. The longer the lateral and the thinner the target zone, the more need there is to be able to make such a correction. Generally corrections to the direction or inclination that are made in the lateral portion should be made with a longer curvature than that used for forming the short radius portion of the wellbore. The curvature of the short radius portion of the wellbore may be typically 200° per one hundred feet. Corrections are typically in the order of 10° per hundred feet. The design of a curve drilling assembly to achieve a particular curvature is controlled or determined by its characteristic length and the eccentricity of the deflection sleeve. For example, if a short radius curve-drilling assembly has a characteristic length of 16 inches and an eccentricity of 0.625 inches, in order to increase the radius of curvature, either the characteristic length must be significantly increased or the eccentricity must be significantly reduced. If the length is kept at 16 inches then the eccentricity must be reduced to 0.037 in order the increase the curvature to 10° per hundred feet. This amount is less than the normal variation in the wellbore diameter and would most likely make the performance of the assembly unpredictable. In otherwords, its not practical to achieve reduced curvature by reducing the eccentricity.

Alternatively, the characteristic length can be increased to accomplish reduced curvature. If the eccentricity is kept at 0.625 inches then the length needs to be increased to 104 inches. Although an assembly with these dimensions would perform predictably the assembly would be too long to pass through the short radius portion of the curve that must be traversed before entering the lateral or horizontal section of the wellbore.

Figure 1E:
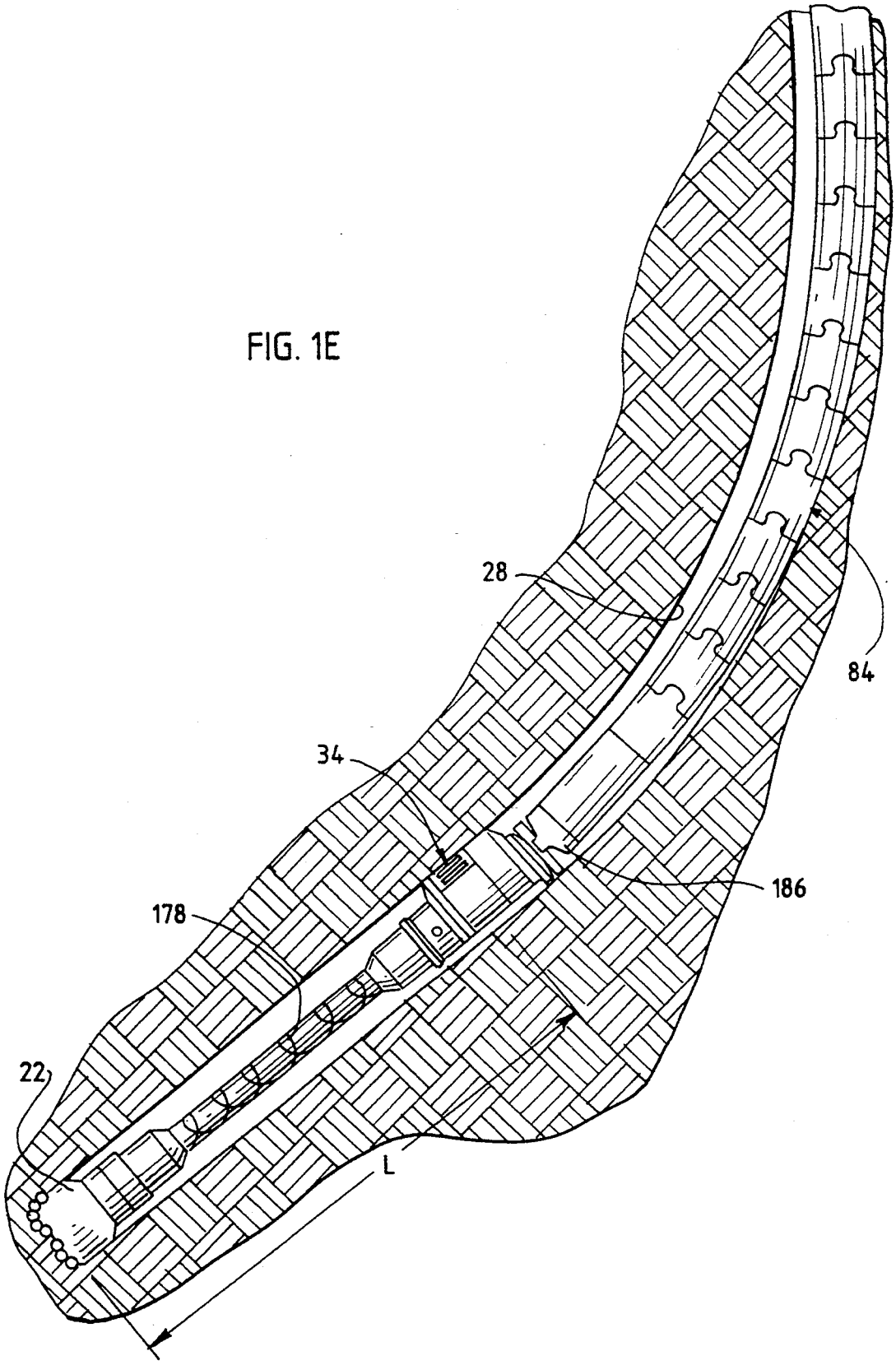

One way to solve this dilemma is to make the spacing member 178 flexible. Refering to FIG. 1E, this can be done by making the spacing member 178 out of a fiberglass/carbon composite pipe similar to the material used to form the used in FIG. 1D. The result is that the assembly is flexible enough to pass through the curve section yet stiff enough to keep the drill bit directed appropriately. In other words, a curve drilling having composite pipe section 178 uphole of the drill bit can be flexible enough to run through a curve section and still provide adequate rigidity for directing the drill bit.

It may also be possible to achieve the same effect using articulated collars having a lobe design that can be made to lock rigidly in place when a compressive force or lobe is applied. It may also be possible to achieve such flexibility in the spacing member by using a high strength steel or titanium material that is flexible enough without exceeding the yield stress of the material when passed through the curve section of the wellbore.

Improved Flexible Joint

The function of the flexible or ball joint assembly 186 is to allow the drill bit 22 to tilt sufficiently in the borehole 26 to drill a short radius curve. It must be capable of transmitting: axial thrust towards the drill bit, tensile force for pulling if the bit becomes stuck, and torque to rotate the drill bit. The flexible joint should also: rotate smoothly, buckle under compressive loading, not straighten under torsional loading, and conduct fluid with minimal leakage.

An advanced flexible joint is described in U.S. Pat. No. 5,213,168. That joint includes two torque transmitting teeth that are engaged nearly over the center of a ball and a thrust bushing that can "wobble" slightly to keep both teeth engaged as the assembly rotates. Wobble is minimized if the tooth loading is kept directly over the center of the ball. That joint has good strength and good operating characteristics for short radius curve drilling. Heretofor previous flexible joints did not prove as satisfactory because they tended to straighten either under compressive or torsional loads.

An improved flexible or ball joint assembly 286 is illustrated in FIGS. 5, 5C, 5D and 5E. It comprises a loading housing 250 and a socket housing 252. The ball joint assembly 286 provides for the transmission of axial and torsional forces through the drill string while permitting drilling fluid to be circulated through the center of the joint.

The loading housing 250 includes a first end 254, an opposite end 256, and a bore 258 extending through its ends 254 and 256. The loading housing 250 is generally cylindrical in shape and has a longitudinal axis 259 extending through its ends 254 and 256. The loading housing 250 also includes a loading member or ball pin 262 disposed in the bore 258 and extending from the first end 254 of the loading housing. The appropriate end 256 of the loading housing 250 is used for connecting the loading housing to a drill string, drill collar, curve drilling assembly, or the like. Preferably, the bore 258 is in fluid communicating contact with a bore 265 of the loading member 262. As shown in the drawings, the loading member 262 has a shaft 263 at one end. The shaft 263 serves to connect the loading member 262 within the loading housing 250.

The socket housing 252 includes a first end 264, an opposite end 266, and a bore 268 extending through the two ends. The socket housing 252 is constructed and arranged to receive the loading member 262 of the loading housing 250 in its bore 268 at its first end 264 by means of a bearing retainer 278 and retaining nut 290. The preferred socket housing 252 is generally cylindrical in shape and has a longitudinal axis 269 extending through its ends 264 and 266. The socket housing opposite end 266 may be formed in the drill pipe, drill collar, mandrel, or the like to which the socket housing 252 is to be connected.

The socket housing 252 includes a thrust bushing or thrust bearing surface 274 that is disposed in the bore 268 of the socket housing 252. The ball pin 262 includes a thrust loading surface 276 for contacting the thrust bearing surface 274 and for transferring thrust between the loading housing 250 and the socket housing 252, as is necessary to transfer the weight-on-bit from the drill string to the remainder curve drilling assembly.

Previous work with short radius drilling assemblies has shown that a flexible joint should have the characteristic that it does not straighten under either axial compressive forces or torsional forces. Moreover, it is preferable that the torsional forces should be transmitted as far from the center line of the joint as possible. Here compressive loads are transmitted by means of the thrust bushing 274 and ball pin 262. Tensile loads are transmitted by means of the bearing retainer 278 and the ball pin 262. Preferably, the thrust bushing 274 and the ball pin 262 are constructed of dissimilar metals or materials to minimize galling. Sealing elements 280 (e.g., O-rings) help confine the drilling fluid into the bore through the center of the ball pin 262 and thrust bushing 274.

Figure 5:
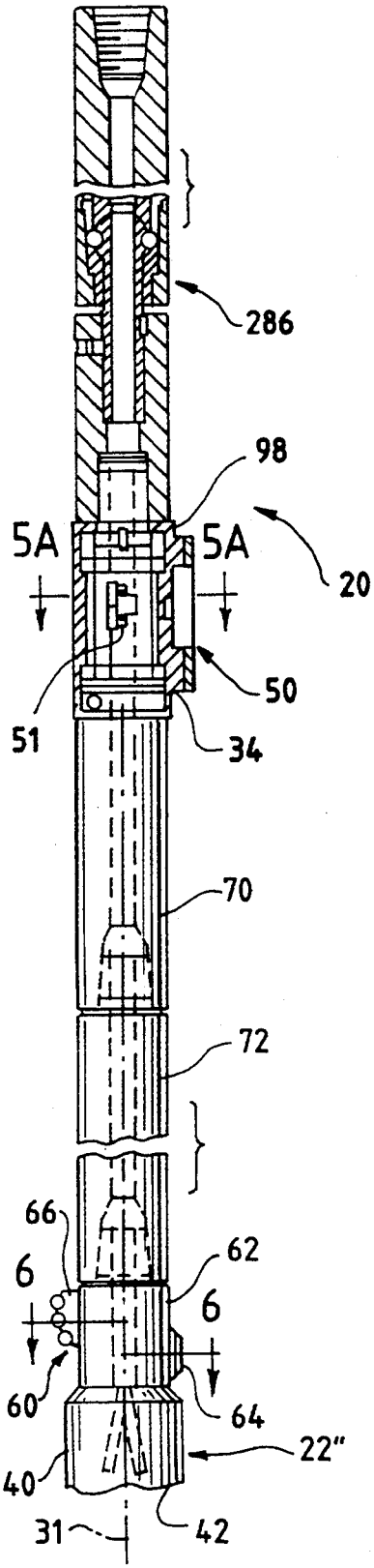
FIG. 5 is a schematic diagram of another embodiment of a curved drilling assembly that is the subject of the present invention.
Figure 5A:
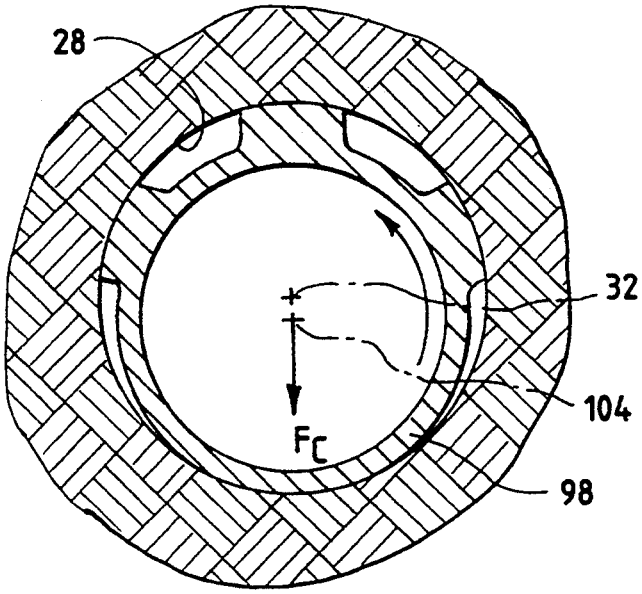
FIGS. 5A and 5B are cross-sectional views of two positions (at high side and 90° left of high side) of the curved guide means of FIG. 5 as viewed along line 5A—5A.
Figure 5B:
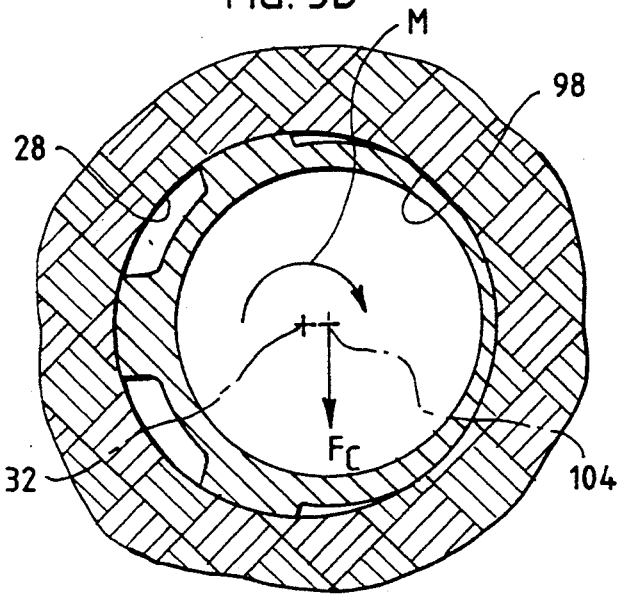
Figure 5E:
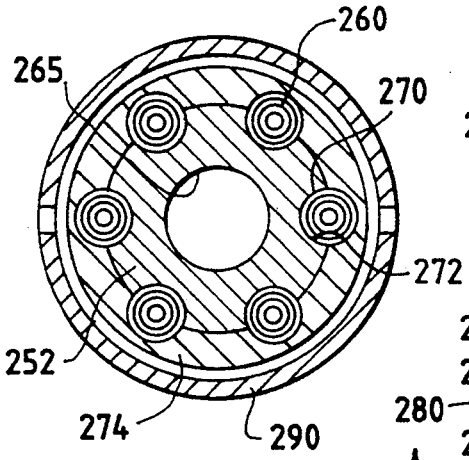
FIGS. 5D and 5E are cross-sectional views of the improved flexible joint of FIG. 5C as viewed along lines 5D—5D and 5E—5E.
Figure 5D:
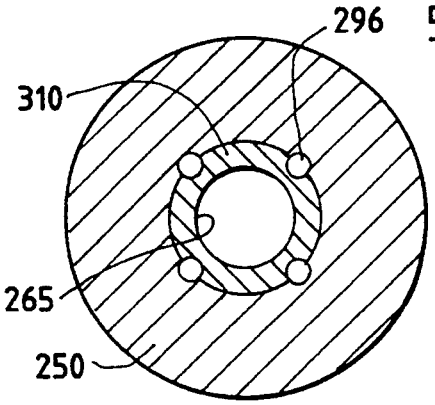
Figure 5C:
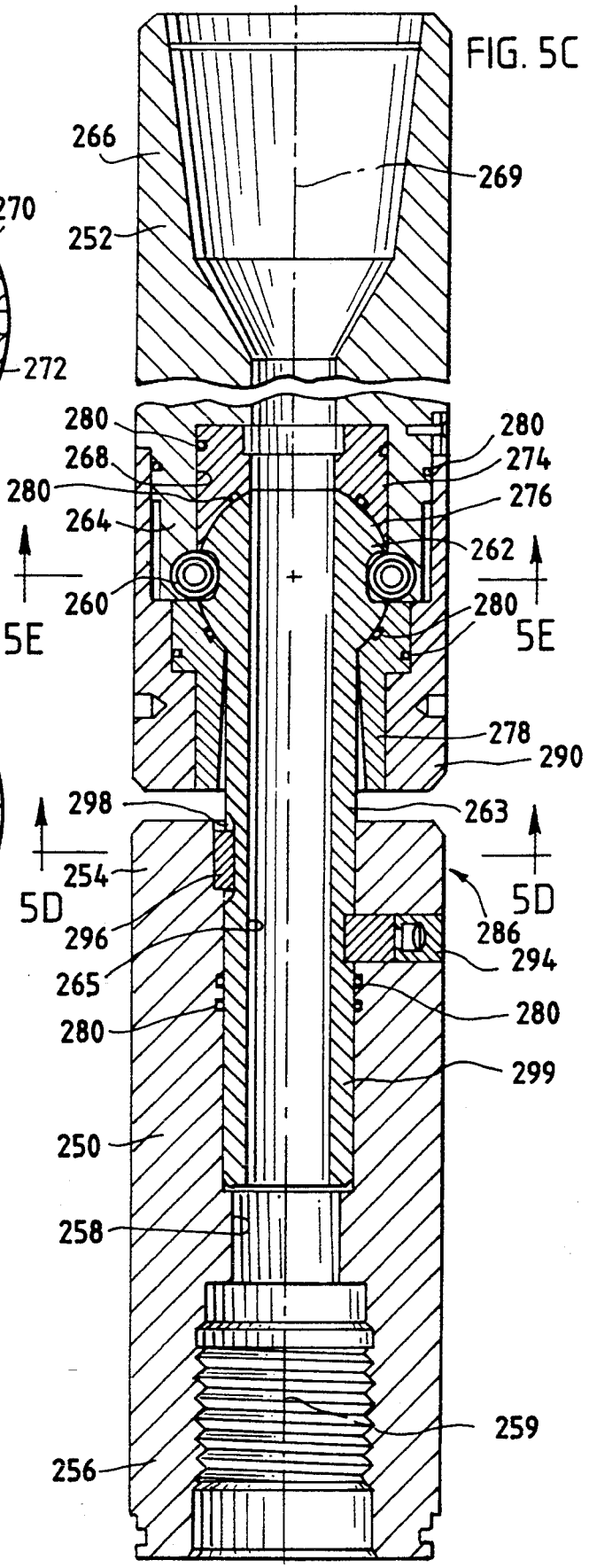
FIG. 5C is an enlarged, cross-sectional elevational view of the improved flexible joint of the assembly shown at the upper end of FIG. 5.

One especially novel feature of the improved flexible joint 286 illustrated in FIGS. 5 and 5C is the method by which torque is transmitted across the joint. Referring to FIG. 5E, six metal balls 260 are located in generally complementary spherical pockets or cavities 270 and 272 in the ball pin 262 and in the thrust bushing 274 for smoothly transmitting the torque. These cavities or pockets 270 and 272 are shaped so that, when the joint is deflected in any direction (within its design limits), all of the balls are equally loaded. In particular, the pockets 270 in the ball pin 262 are substantially spherical to keep the balls 260 in place relative to the center of the "ball" at the end of the ball pin; however, the adjacent pockets 272 are not perfectly spherically complementary in shape (i.e., oval in shape) so as to allow limited relative angular movement (e.g., about a few degrees) of the socket housing 252 relative the loading housing 250. In particular, the thrust loading surface 276 and the thrust bearing surface 274 are constructed and arranged so that the thrust loading surface, when contacting the thrust bearing surface, is pivotable about a pivotal center 292 which is generally coplariat, or radially coincident (with respect to the longitudinal axes 259 and 269 of the two housings 250 and 252), by means of the torque transmitting balls 260.

Another unique feature of the improved ball joint assembly 286 is the method of attaching the ball pin 262 to the loading housing 250 (See FIG. 5D). In particular, a flat key 294 and a set of dowells 296 are used. The flat key 294 is provided to prevent axial movement of the ball pin 262 relative to the loading housing 250. Torsional rigidity is provided by means of four pins or trunion dowells 296 located in grooves 298 between the pin end 299 of the ball pin 262 and the body of the loading housing 250. Seals 280 are provided for pressure integrity.

Preferably, as exemplified in FIG. 5C, the thrust loading surface 276 and thrust bearing surface 274 are mating convex and concave surfaces in order to facilitate pivotal motion when thrust is being transferred between the loading housing 250 and socket housing 252. As exemplified in FIG. 5C, the preferred thrust loading surface 276 is convex in shape and the thrust bearing surface 274 is concave in shape, although either surface 274 and 276 may be convex with the other being concave. In one prototype flexible joint 286, the thrust loading surface 276 and the bearing retainer 278 form a spherical cavity for the ball end of the ball pin 262.

The flexible joint 186 may be located at either of the curve guide means 34, and is typically placed at the same end of the curve guide means as is the engaging means 50. Either the loading housing 250 or the socket housing 252 may be used to connect the flexible joint 186 to the mandrel 86. In FIG. 2 the engaging means 50 and flexible joint 186 are located at the downhole end 90 of the mandrel 86. There, the lower end of the socket housing is disposed towards the downhole end of the mandrel 86. In FIG. 5, the engaging means 50 is located opposite to that of FIG. 2.

Improved Assembly

Referring to FIG. 2 a lateral force is generated on the borehole by the cutters 44 on the drill bit 22. This force $F_c$ is resisted by a reactive force $F_R$ on a sliding pad 48 that is slightly uphole from the bottom of the drill bit 22. Test data has shown that the force $F_R$ on the sliding pad 48 acts or is directed towards the top end of the pad (i.e., because most of the wear is at the uphole end of the pad.) Since the cutting force $F_C$ and the reactive force $F_R$ do not act at the same axial point along the axis 31 of the drill bit 22, a moment is formed that imparts a lateral force $F_L$ on the ball joint assembly 186 (i.e., since the ball joint is the closest non-rigid part of the drill string). In particular, the lateral/side force $F_L$ tries to push the ball 162 out of its socket 176, thus causing wear to the joint and subsequent displacement of the axis 31 of the drill bit 22. This displacement may be sufficient to affect the radius of curvature $R_c$ drilled by the assembly 20.

The lateral force $F_L$ on the ball joint assembly 186 can be minimized by reducing the axial separation of the cutter force $F_C$ and the pad reactive force $F_R$. In one assembly, before the problem was recognized, the axial separation between the two forces $F_C$ and $F_R$ was estimated to be about three inches for a 3 15/16 inch diameter drill bit. A drill bit of the same diameter having a gauge closer to the end of the drill bit should provide better performance.

The moment formed by these two forces $F_R$ and $F_C$ can be also reduced by distributing part of the cutting force $F_C$ axially above the pad 48 as well as below the pad. This is illustrated in FIGS. 3 and 4. By designing the drill bit 22' with this concept in mind the moment formed by $F_R$ and $F_C$ can, for all practical purposes, be removed as a design limitation on the ball joint.

Referring to FIG. 3, that drill bit 22' has an added advantage in that it minimizes the clearance problem when it is used in a tight (e.g., short radius) borehole. More specifically, as soon as the drill bit 22' is pulled a distance about equal to the length of the pad 48, the drill bit moves into a borehole that is somewhat larger than the greatest diametrical dimension of the drill bit. This provides adequate clearance so that, if the drill bit 22' is slightly tilted or if it drags debris above it, there is little tendency for the drill bit to become stuck in the borehole 26.

Again referring to FIG. 3, the drill bit 22' rotates about a center line or axis 31 determined by cutters **5*a* and 6*a* and the sliding pad 48. Gage cutters 56*a* and 56*b* are radially displaced further from the center line 31 of the drill bit 22' than the sliding pad 48 (i.e., $R_C$ is greater than $R_P$). Thus, as the drill bit 22' is rotated, the gage cutters 56*a* and 56*b* cut a bore to a diameter given by twice the radius $R_C$ (i.e., $2R_C$). Moreover, as soon as the drill bit 22' is pulled a distance slightly larger than the pad length, it moves into a portion of the borehole that is somewhat larger than the greatest diametrical dimension $R_P$ plus $R_C$. In one design, the difference between the bore diameter and the effective diameter of the drill bit 22' is on the order of 1/16th of an inch. This provides adequate clearance so that if the drill bit 22'** is slightly tilted or if it drags debris above it, there is little tendency for it to become stuck in the borehole.

Second Improved Assembly

Referring to FIG. 5, testing of similar curved drilling assemblies has demonstrated that it could be used to increase the inclination of a well bore up to 35° at a build rate of 5° per 100 feet. However, after the inclination reached 35°, any attempt to drill with the eccentricity of the drilling assembly oriented 90° from the plane of curvature (i.e., in order to change the direction of the borehole) was unsuccessful. As soon as the drilling resumed after orienting the eccentric sleeve 98 (and in some instances even before the drilling resumed), the sleeve rotated so that the joint was located on the outside of the curve. This rotation appeared to be caused by the combination of gravity and bending forces creating a moment (see FIGS. 5A and 5B) to cause the sleeve 98 to be unstable when oriented right or left of the high side. Although contact forces are reduced when there is no curvature in the hole, gravitational forces acting on the assembly, appear to be enough to sometimes prevent maintaining the ,desired orientation of the sleeve.

Figure 7:
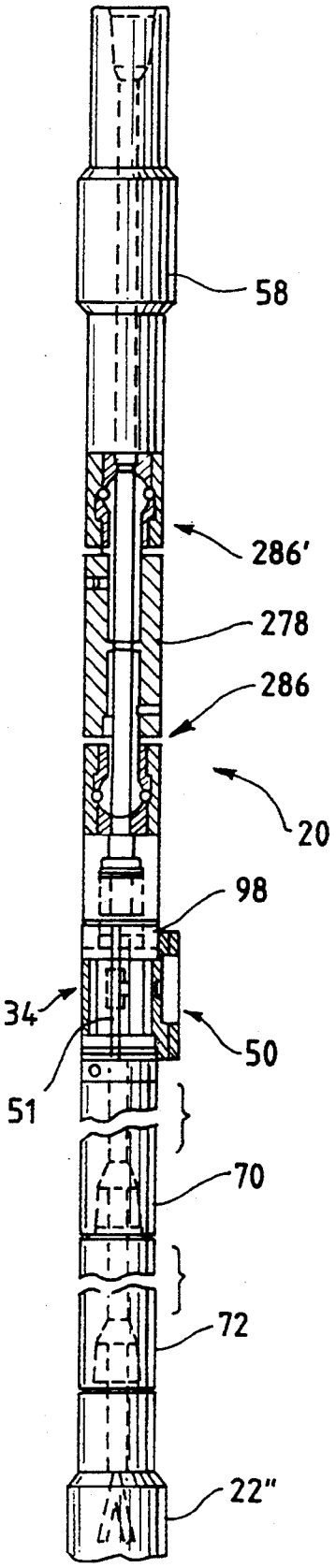
FIG. 7 is a schematic diagram of yet another embodiment of a curved drilling assembly that is the subject of the present invention.

Bending and the gravitational forces can be reduced by adding a second flexible or ball joint, a spacing member between the two joints, and a stabilizer to the assembly. This is illustrated in FIG. 7. Both the bending and gravity forces from the collars above the joint are supported by the stabilizer 58. Thus, they do not form a moment to rotate the sleeve 98. The gravitational force from the assembly components below the joint will still be supported on the eccentric sleeve 98. Sharp, axially aligned, spring-loaded blades 51 on the sides of the eccentric sleeve 98 further help maintain its orientation.

The length of the spacing member 278 between the two flexible joints 286 and 286' is determined by considering the degree of eccentricity of the sleeve 98. In one situation, the length of the spacing member 278 was selected so that the maximum flexure at the joint is about one degree. The inclination of the spacing member 278 provides an additional benefit in that the weight-on-bit (WOB) force causes a radial component to be directed to the backside of the eccentric sleeve 98; this tends to hold it in place. This effect may be amplified by incorporating sharp axially oriented ridges on the bottom side of the eccentric sleeve.

When using curved drilling assemblies, similar to those illustrated in FIGS. 1 and 2, considerable drag is sometimes experienced when tripping the assembly 20 out of the hole. This is believed to be due to pulling the non-rotating sleeve 98 past permeable zones that have a thicker filter cake. Adding a rotating stabilizer 58 at a short distance above the sleeve 98 provides one means for removing this filter cake when the drill string is rotated. Drag can be further reduced by circulating drilling fluid and rotating the drill string past any permeable zones that may have thick deposits of filter cake.

Third Improved Assembly

Testing of 3 15/16 inch short radius curve drilling tools and an 8½ inch long radius drilling tool similar to those illustrated in FIGS. 1A and 1B has shown that it is very beneficial to prevent bit whirl when drilling a controlled curvature wellbore. This is the subject of U.S. Pat. No. 5,213,168. These tests have also shown that the drill bit of FIGS. 3 and 4 reduces drag when the drilling assembly is pulled from the borehole. It would be advantageous if at least some of the benefits of an anti-whirl drill bit or bi-center bit could be attained while using a standard drill bit (both roller-cone and drag) in a curved drilling assembly.

Figure 6:
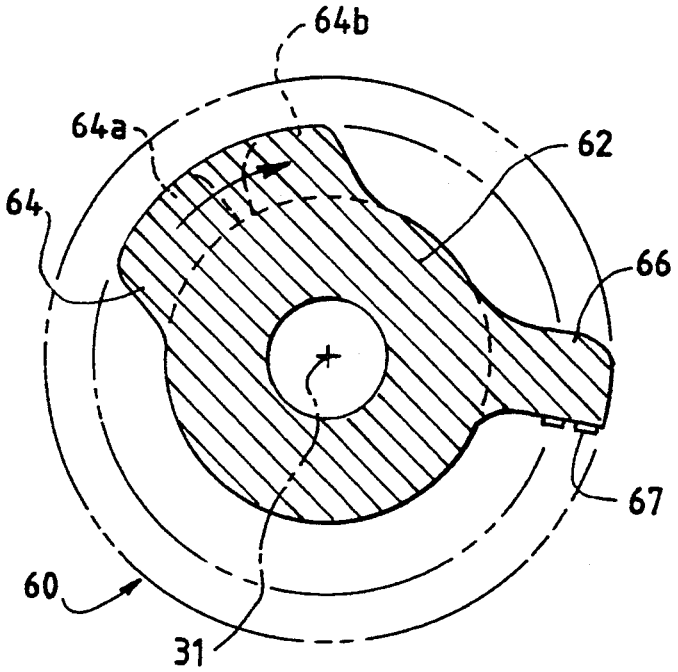
FIG. 6 is a cross-sectional view of the reaming sub of FIG. 5 as viewed along line 6—6.

One way to do this is to use a standard drill bit in combination with a reaming sub (e.g., PDC or roller reamer) located above the drill bit. FIGS. 5 and 6 illustrate one such apparatus. A reaming sub 60 (e.g., PDC or roller reamer) located above a standard drill bit 22''. This combination simultaneously provides whirl preventing stability and bi-centered hole enlarging benefits. In this illustration the rotary drill bit 22'' has a base portion 36 that is disposed about a longitudinal bit axis 31 for connecting to the downhole end of curved guide means 34 (via spacers 70 and 72), has a side portion 40, has a face portion 42 and has cutting means disposed on the face portion. The cutting means may produce a lateral force on the drill bit in response to the rotation of the drill bit in the borehole; however for a standard or conventional drill bit 22'', this force is small. The body 62 of the reaming sub 60 carries a reaction member 64 and a reaming element 66.

The reaming element 66 is located above the reaction member 64. The reaming element enlargingly reams or opens the bore cut by the drill bit 22''. The reaming element 66 extends radially relative to the longitudinal axis 31 and at a predetermined axial distance above the drill's cutting means. The reaming element 66 is located angularly in advance of the reaction member 64 by a maximum of about 180 degrees. The reaming element 66 engages the borehole wall and produces a lateral force on the borehole. Preferrably the reaming element 66 produces a lateral force that is larger than any comperable force produced by the drill bit 22'' (i.e., the net lateral force is located as if it were only from the reaming element).

The reaction member 64 is located above the gauge portion of the drill bit 22''. The reaction member 64 substantially continuously contacts the borehole wall 28 during drilling and receives a reactive force that is from the borehole and that is in response to the net lateral force due to the reaming element 66 and the drill bit 22''. The reaction member 64 extends from the longitudinal bit axis 31 by no more than the bore cut by the drill's cutting elements. The reactive force and the lateral force form a downhole-moment that is opposed by an uphole-moment having a force component that is directed at the flexible joint 286. The reaction member 64 may comprise a sliding or a rolling, non-cutting element.

Preferrably the reaming element 66 is located relatively close to the drill bit 22'' compared to the distance from the drill bit to the flexible joint 286, such that the magnitude of the down-hole moment and the magnitude of the up-hole moment are lower than the magnitude of the downhole-moment and the magnitude of the uphole-moment which would be present if said reaming element were located at a greater axial distance from the drill bit. In other words, the uphole-moment and downhole-moment are less than that which would be present if the reaming element 66 was located farther from the drill bit. Preferably, the reaming element 66 is located in advance of the reaction member by a minimum of sixty degrees (See FIG. 6).

As shown in FIG. 6 the reaming element 66 comprises a radially disposed arm 67 and a plurality of cutters 68 carded by the arm. As shown in FIG. 6 the reaction member 64 comprises one pad; a plurality of pads, 64*a* and 64*b* (shown in phantom) may be preferable in some designs. In operation reamer sub 60 enlarges the bore a small amount to provide clearance when withdrawing the tool from the borehole. It also provides the radial force for driving the tool against the "low friction" reaction member 64 to minimize bit whirl.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made, materials substituted and features of the invention may be utilized. For example, the drill bit of FIGS. 5 and 7 can be a roller cone drill bit. Moreover, it is possible that some standard PDC drag bits have a gauge pad which by itself could function as the low friction reaction member for the apparatus illustrated in FIGS. 1, 5 and 7, thereby obviating the need for a separate reaction member on the reaming sub. Thus, it will be appreciated that various modifications, alternatives, variations, etc., may be made without departing from the spirit and scope of the invention as defined in the appended claims. It is, of course, intended to cover by the appended claims all such modifications involved within the scope of the claims.

We claim:

1. In a curve drilling assembly that is connectable to a rotary drill string for drilling a curved subterranean borehole having a bottom, having a wall, having an inside radius and having an outside radius, the assembly comprising curve guide means connectable with the drill string for guiding the drill string through a curved path, a flexible joint that is carried by the curve guide means, and a rotary drill bit having a base portion disposed about a longitudinal bit axis for connecting to the downhole end of the drill string, having a side portion that is disposed about the longitudinal bit axis, that extends from the base portion, that has an uphole end and that has a downhole end, having a face portion disposed about the longitudinal bit axis and extending from the side portion, and having a plurality of cutting elements that produce a lateral force on the drill bit at the downhole end of the drill bit in response to the rotation of the drill bit in the borehole, wherein the improvement comprises:

bearing means, carried by the side portion of the drill bit, for substantially continuously contacting the borehole wall during drilling and for receiving a reactive force that is from said borehole that is in response to the lateral force on the drill bit and that is directed to a location adjacent to the uphole end of the side portion of said drill bit, wherein said reactive force and said lateral force form a downhole-moment that is about the drill bit and that is opposed by an uphole-movement having a force component that is directed at the flexible joint, wherein the uphole end of said bearing means is located at a predetermined axial distance from the face of the drill bit such that the magnitude of said downhole-moment and the magnitude of said uphole-moment are lower than the magnitude of the downhole-moment and the magnitude of said uphole-moment which would be present if the uphole end of the bearing means were located at an axial distance that is greater than said predetermined axial distance wherein the flexible joint is located at a fixed axial distance from the face of the drill bit; and wherein said predetermined axial distance is less than one-half of said fixed axial distance to minimize said magnitude of the down-hole moment and said magnitude of said up-hole moment.

2. In a curve drilling assembly that is connectable to a rotary drill string for drilling a curved subterranean borehole having a bottom, having a wall, having an inside radius and having an outside radius, the assembly comprising curve guide means connectable with the drill string for guiding the drill string through a curved path, a flexible joint that is carried by the curve guide means, and a rotary drill bit having a base portion disposed about a longitudinal bit axis for connecting to the downhole end of the drill string, having a side portion that is disposed about the longitudinal bit axis, that extends from the base portion that has an uphole end and that has a downhole end, having a face portion disposed about the longitudinal bit axis and extending from the side portion, and having a plurality of cutting elements that produce a lateral force on the drill bit at the downhole end of the drill bit in response to the rotation of the drill bit in the borehole, wherein the improvement comprises:

bearing means, carried by the side portion of the drill bit, for substantially continuously contacting the borehole wall during drilling and for receiving a reactive force that is from said borehole, that is in response to the lateral forge on the drill bit and that is directed to a location adjacent to the uphole end of the side portion of said drill bit, wherein said reactive force and said lateral force form a downhole-moment that is about the drill bit and that is opposed by an uphole-moment having a force component that is directed at the flexible joint, wherein the uphole end of said bearing means is located at a predetermined axial distance from the face of the drill bit such that the magnitude of said downhole-moment and the magnitude of said uphole-moment are lower then the magnitude of the downhole-moment and the magnitude of said uphole-moment which would be present if the uphole end of the bearing means were located at an axial distance that is greater than said predetermined axial distance, and further including at least one cutting element that is located adjacent to the base portion of the drill bit and at a radial distance from the longitudinal bit axis that is greater than that of the plurality of cutting elements.

3. In a curve drilling assembly that is connectable to a rotary drill string for drilling a curved subterranean borehole having a bottom, having a wall, having an inside radius and having an outside radius, the assembly comprising curve guide means connectable with the drill string for guiding the drill string through a curved path, a flexible joint that is carried by the curve guide means, and a rotary drill bit having a base portion disposed about a longitudinal bit axis for connecting to the downhole end of the drill string, having a side portion that is disposed about the longitudinal bit axis, that extends from the base portion, that has an uphole end and that has a downhole end, having a face portion disposed about the longitudinal bit axis and extending from the side portion, and having a plurality of cutting elements that produce a lateral force on the drill bit at the downhole end of the drill bit in response to the rotation of the drill bit in the borehole, wherein the improvement comprises:

bearing means, carried by the side portion of the drill bit, for substantially continuously contacting the borehole wall during drilling and for receiving a reactive force that is from said borehole, that is in response to the lateral force on the drill bit and that is directed to a location adjacent to the uphole end of the side portion of said drill bit, wherein said reactive force and said lateral force form a downhole-moment that is about the drill bit and that is opposed by an uphole-moment having a force component that is directed at the flexible joint, wherein the uphole end of said bearing means is located at a predetermined axial distance from the rage of the drill bit such that the magnitude of said downhole-moment and the magnitude of said uphole-moment are lower than the magnitude of the downhole-moment and the magnitude of said uphole-moment which would be present if the uphole end of the bearing means were located at an axial distance that is greater than said predetermined axial distance wherein the cutting elements comprise one set of cutting elements that is located adjacent to the downhole end of said side portion of the drill bit, and a second set of cutting elements that is located adjacent to the uphole end of the side portion of the drill bit; and wherein said one set of cutting elements is located at a radial distance from the longitudinal bit axis that is less than the radial distance that said second set of cutting elements is located from the longitudinal bit axis.

4. A rotary drill bit for drilling a curved subterranean borehole in combination with a drill string having a flexible joint that is located at a predetermined distance from the end of the drill string, comprising:

a base portion disposed about a longitudinal bit axis for connecting to the end of the drill string:

a side portion that is disposed about said longitudinal bit axis, that extends from said base portion, that has an uphole end and that has a downhole end, a face portion disposed about said longitudinal bit axis and extending from said gauge portion, a plurality of cutting elements that are carried by said face portion of the drill bit and that produce a lateral force on the drill bit at the downhole end of the drill bit in response to the rotation of the drill bit in the borehole, and bearing means, located on said side portion of the drill bit, for substantially continuously contacting the borehole wall during drilling and for receiving a reactive force that is from said borehole, that is in response to said lateral force and that is directed to a location adjacent to said uphole end of said side portion of said drill bit, said reactive force and said lateral force forming a downhole-moment that is about said face portion of the drill bit and that is opposed by an uphole-moment having a force component that is directed at the flexible joint, wherein the uphole end of said bearing means is located relatively close to said cutting elements relative to the distance between the flexible joint and said cutting elements such that the magnitude of said downhole-moment and the magnitude of said uphole-moment are lower than the magnitude of the downhole-moment and the magnitude of said uphole-moment which would be present if said bearing means were located at an axial distance that is closer to said cutting elements, and wherein the predetermined distance is between two and five times the distance between said face of said drill bit and said bearing means.

5. The curve drilling bit of claim 4, further including at least one radially disposed cutting element that is located adjacent to the uphole end of said bearing means.

6. The curve drilling bit of claim 4, wherein said plurality of cutting elements comprise one set of cutting elements that is generally located adjacent to said downhole end of said side portion of the drill bit; further including a second set of cutting elements that is located adjacent to said uphole end of said side portion of the drill bit; and wherein said one set of cutting elements are located at a radial distance from said longitudinal bit axis that is less than the radial distance that said second set of cutting elements are located from said longitudinal bit axis.

7. In a curve drilling assembly that is connectable to a rotary drill string for drilling a curved subterranean borehole having a bottom, having a wall, having an inside radius and having an outside radius, the assembly comprising:

curve guide means connectable with the drill string for guiding the drill string through a curved path, a flexible joint that is located intermediate the ends of the drill string, and a rotary drill bit having:

a base portion that is disposed about a longitudinal bit axis for connecting to the downhole end of the drill string at a predetermined distance from the flexible joint;

a side portion that is disposed about the longitudinal bit axis, that extends from the base portion, that has an uphole end and that has a downhole end;

a face portion disposed about the longitudinal bit axis and extending from the side portion of the drill bit; and a plurality of cutting elements that are carried by at least the face portion of the drill bit and that produce a lateral force on the drill bit at the downhole end of the drill bit in response to the rotation of the drill bit in the borehole;

wherein the improvement comprises:

a drill bit having on its side portion bearing means for substantially continuously contacting the borehole wall during drilling and for receiving a reactive force that is from the borehole, that is in response to said lateral force and that is directed to a location adjacent to the uphole end of said side portion of the drill bit, said reactive force and said lateral force forming a downhole-moment that is about the face portion of the drill bit and that is opposed by an uphole-moment having a force component that is directed at the flexible joint; and at least one cutting element, located on the drill bit adjacent to the uphole end of said bearing means, for producing a counter-force to reduce the magnitude of said down-hole moment and the magnitude of said up-hole moment.

8. The curve drilling assembly of claim 7, wherein said at least one cutting element is located at a radial distance from the longitudinal bit axis of the drill bit that is greater than that of substantially all of said cutting elements that are carried by the face portion of the drill bit.

9. In a curve drilling assembly that is connectable to a rotary drill string for drilling a curved subterranean borehole having a bottom, having walls, having an inside radius and having an outside radius, the assembly comprising curve guide means connectable with the drill string for deflecting the drill string toward the outside radius of the curved borehole, a flexible joint that is carried by the curve guide means and that is located at a predetermined distance from a rotary drill bit, said drill bit comprising:

a base portion disposed about a bit axis for connecting to the drill string, a middle portion that is disposed about said bit axis, that extends from said base portion, that has an uphole end and that has a downhole end, a face portion disposed about said bit axis and extending from said middle portion, cutting elements that are carried by at least said face portion and that produce a lateral force on the drill bit at the downhole end of the drill bit in response to the rotation of the drill bit in the borehole, and a bearing surface, located on said middle portion of the drill bit, for substantially continuously contacting the borehole wall during drilling and for receiving a reactive force that is from said borehole, that is in response to said lateral force and that is directed to a location adjacent to said uphole end of said middle portion of said drill bit, said reactive force and said lateral force forming a downhole-moment that is about said face portion of the drill bit and that is opposed by an uphole-moment having a force component that is directed at the flexible joint, wherein said cutting elements comprise one set of cutting elements that is carried by said face portion adjacent to said downhole end of said bearing means and a second set of cutting elements that is carried by said middle portion adjacent to said uphole end of said bearing means, and wherein said one set of cutting elements is located at a radial distance from said bit axis that is less than the radial distance that said second set of cutting elements is located from said bit axis.

10. The curve drilling assembly of claim 9, wherein the quantity of said cutting elements in said second set of cutting elements is less than the quantity of said cutting elements in said one set of cutting elements.

11. The curve drilling assembly of claim 9, wherein said drill bit is an anti-whirl drill bit, and wherein said bearing means is located in the cutter devoid region of said anti-whirl drill bit.

12. In a curve drilling assembly that is connectable to a rotary drill string for drilling a curved subterranean borehole having a bottom, having walls, having an inside radius and having an outside radius, the assembly having curve guide means connectable with the drill string for deflecting the drill string toward the outside radius of the curved borehole, having a flexible joint located intermediate the ends of the drill string and having a rotary drill bit comprising:

a base portion disposed about a drilling axis for connecting to the downhole end of the drill string;

a middle portion that is disposed about said drilling axis, that extends from said base portion, that has an uphole end and that has a downhole end;

a face portion disposed about said longitudinal bit axis and extending from said middle portion;

a first set of cutting elements that is carried by said face portion of the drill bit at a first predetermined radial distance from said drilling axis;

a second set of cutting elements that is carried by said middle portion of the drill bit at a second radial distance from said drilling axis and at a predetermined axial distance from said first set of cutting elements, wherein said second radial distance is greater than said first radial distance and said first set of cutting elements, said first set of cutting elements and said second set of cutting elements producing a lateral force on the drill bit at the downhole end of the drill bit in response to the rotation of the drill bit in the borehole; and bearing means, located on said middle portion of the drill bit and between said first set of cutting elements and said second set of cutting elements, for substantially continuously contacting the borehole wall during drilling and for receiving a reactive force that is from said borehole, that is in response to said lateral force and that is directed to a location adjacent to said uphole end of said middle portion of said drill bit, said reactive force and said lateral force forming a downhole-moment that is about said face portion of the drill bit and that is opposed by an uphole-moment having a force component that is directed at the flexible joint.

13. The rotary drill bit of claim 12, wherein the axial separation of said first set of cutting elements and said second set of cutting elements across said bearing means is sufficiently small that said magnitude of said downhole-moment and said magnitude of said uphole-moment are lower than the magnitude of the downhole-moment and the magnitude of said uphole-moment which would be present if said first set of cutting elements and said second set of cutting elements were axially separated at a distance that is greater than said predetermined distance.

14. The rotary drill bit of claim 12, wherein said force component that is directed at the flexible joint in response to said first set of cutting elements and said second set of cutting elements rotating in said borehole is less than the force component directed at the flexible joint in response to said first set of cutting elements rotating in said borehole.

15. A rotary drill bit for drilling a curved subterranean borehole, comprising:

a base portion disposed about a drilling axis for connecting to the downhole end of a drill string having a flexible joint located therein, a middle portion that is disposed about said drilling axis, that extends from said base portion, that has an uphole end and that has a downhole end, a face portion disposed about said drilling axis and extending from said middle portion, cutting elements that are carried by at least said face portion of the drill bit and that produce a lateral force on the drill bit at the downhole end of the drill bit in response to the rotation of the drill bit in the borehole, and bearing means, located on said middle portion of the drill bit, for substantially continuously contacting the borehole wall during drilling and for receiving a reactive force that is from said borehole, that is in response to said lateral force and that is directed to a location adjacent to said uphole end of said middle portion of said drill bit, said reactive force and said lateral force forming a downhole-moment that is about said face portion of the drill bit and that is opposed by an uphole-moment having a force component that is directed at the flexible joint, wherein said cutting elements comprise one set of cutting elements that are carried by said face portion of the drill bit and a second set of cutting elements that are located adjacent to said uphole end of said bearing means, and wherein substantially all of said cutting elements of said one set of cutting elements are located at a radial distance from said drilling axis that is less than the radial distance that said second set of cutting elements is located from said drilling axis.

16. A rotary drill bit for drilling a curved subterranean borehole, comprising:

a base portion disposed about a drilling axis for connecting to a drill string having a flexible joint;

a middle portion that is disposed about said drilling axis, that extends from said base portion, that has an uphole end and that has a downhole end;

a face portion disposed about said drilling axis and extending from said middle portion;

a first set of cutting elements that is carried by said face portion of the drill bit at a first predetermined radial distance from said drilling axis;

a second set of cutting elements that is carried by said middle portion of the drill bit at a predetermined distance from said first set of cutting elements and at a second radial distance from said drilling axis, wherein said second radial distance is greater than said first radial distance, all of said cutting elements producing a lateral force on the drill bit at the downhole end of the drill bit in response to the rotation of the drill bit in the borehole; and bearing means, located on said middle portion of the drill bit and between said first set of cutting elements and said second set of cutting elements, for substantially continuously contacting the borehole wall during drilling and for receiving a reactive force that is from said borehole, that is in response to said lateral force and that is directed to a location adjacent to said uphole end of said middle portion of said drill bit, said reactive force and said lateral force forming a downhole-moment that is about said face portion of the drill bit and that is opposed by an uphole-moment having a force component that is directed at the flexible joint, wherein the separation of said first set of cutting elements and said second set of cutting elements across said bearing means is sufficiently small that said magnitude of said downhole-moment and said magnitude of said uphole-moment are lower than the magnitude of the downhole-moment and the magnitude of said uphole-moment which would be present if said first set of cutting elements and said second set of cutting elements were axially separated at a distance that is greater than said predetermined distance.

17. In a curve drilling assembly that is connectable to a rotary drill string for drilling a curved subterranean borehole having a bottom, having walls, having an inside radius and having an outside radius, the assembly comprising:

curve guide means connectable with the drill string for deflecting the drill string toward the outside radius of the curved borehole;

a flexible joint located intermediate the ends of the drill string;

a drill bit having a base portion disposed about a longitudinal bit axis for connecting to the downhole end of the rotary drill string and having a plurality of cutting elements;

a reaming element, carried by the drill string and located above said drill bit, for enlargingly reaming the bore cut by said drill bit by engaging the walls of the borehole, said reaming element extending radially relative to said longitudinal axis and at a predetermined axial distance above said cutting elements of said drill bit, said reaming element producing a lateral force in response to said reaming element engaging the walls of the borehole; and a reaction member, carried by the drill string and located between said drill bit and said reaming element, for substantially continuously contacting the borehole wall during drilling and for receiving a reactive force that is from the borehole and that is in response to said lateral force, said reaction element extending form said longitudinal bit axis by no more than the bore cut by said drill bit, said reactive force and said lateral force forming a downhole-moment that is opposed by an uphole-moment having a force component that is directed at said flexible joint, said reaming element being located angularly in advance of said reaction member by a maximum of 180 degrees.

18. The curve drilling assembly of claim 17, wherein said reaction member comprises a sliding pad.

19. The curve drilling assembly of claim 17, wherein said reaction member comprises a rolling, non-cutting element.

20. The curve drilling assembly of claim 17, wherein said reaming element is located in advance of said reaction member by a minimum of sixty degrees.

21. The curve drilling assembly of claim 17, wherein said drill bit is a roller cone drill bit.

22. The curve drilling assembly of claim 17, further including a sub for connecting the base portion of the drill bit to said downhole end of the drill string, said sub having a downhole end for carrying said reaction member and having a uphole end for carrying said reaming element.

23. The curve drilling assembly of claim 17, wherein said flexible joint has one end carried by said curve guide means.

24. In a curved drilling assembly having a flexible joint intermediate its ends and having a drill bit at its downhole end for forming a borehole, a reaming sub comprising:

a sub for connecting the base portion of the drill bit to the downhole end of the curved drilling assembly, said sub having a downhole end, a uphole end and an axis of rotation;

reaming means, carried by said sub at its uphole end, for enlargingly reaming the bore cut by the drill bit, said reaming means producing a lateral force on said sub in response to engaging the bore cut by said drill bit; and a reaction member, carried by said sub at its downhole end, for substantially continuously contacting a portion of said bore during drilling and for receiving a reactive force that is from the borehole and that is in response to said lateral force, said reaction member extending radially from said axis of said sub by no more than the bore cut by the drill bit and said reaming means being located angularly in advance of said reaction member by a maximum of 180 degrees.

25. The reaming sub of claim 24, wherein said reactive force and said lateral force form a downhole-moment that is about said sub and that is opposed by an uphole-moment having a force component that is directed at the flexible joint; and wherein said reaming means is located at a predetermined axial distance from the drill bit's cutting elements such that locating said reaming means at a greater axial distance results in an increase in the magnitude of said force component that is directed at the flexible joint.

26. The reaming sub of claim 24, wherein said reaction member comprises two reaction member elements, each of said reaction member elements substantially and continuously contacting said portion of the borehole wall during drilling and receiving components of said reactive force.

27. The reaming sub of claim 24, wherein said reaction member is selected from the group comprising a sliding pad and a rolling, non-cutting element.

28. The reaming sub of claim 24, wherein said reaming means is located in advance of said reaction member by a minimum of sixty degrees.

29. In a curve drilling assembly that is connectable to a rotary drill string for drilling a curved subterranean borehole having a bottom, having a wall, having an inside radius and having an outside radius the assembly comprising curve guide means connectable with the drill string for guiding the drill string through a curved path, a flexible joint that is carried by the curve guide means, and a rotary drill bit having a base portion disposed about a longitudinal bit axis for connecting to the downhole end of the drill string, having a side portion that is disposed about the longitudinal bit axis, that extends from the base portion, that has an uphole end and that has a downhole end, having a face portion disposed about the longitudinal bit axis and extending from the side portion, and having a plurality of cutting elements that produce a lateral force on the drill bit at the downhole end of the drill bit in response to the rotation of the drill bit in the borehole, wherein the improvement comprises;

bearing means, carried by the side portion of the drill bit, for substantially continuously contacting the borehole wall during drilling and for receiving a reactive force that is from said borehole, that is in response to the lateral force on the drill bit and that is directed to a location adjacent to the uphole end of the side portion of said drill bit, wherein said reactive force and said lateral force form a downhole-moment that is about the drill bit and that is opposed by an uphole-moment having a force component that is that is opposed by an uphole-moment having a force component that is directed at the flexible joint, wherein the uphole end of said bearing means is located at a predetermined axial distance from the face of the drill bit such that the magnitude of said downhole-moment and the magnitude of said uphole-moment are lower than the magnitude of the downhole-moment and the magnitude of said uphole-moment which would be present if the uphole end of the bearing means were located at an axial distance that is greater than said predetermined axial distance, and further including a flexible section of pipe for connecting the drill bit to the flexible joint.

* * * * *

UNITED STATES PATENT AND TRADEMARK OFFICE
CERTIFICATE OF CORRECTION

PATENT NO.: 5,423,389

DATED: June 13, 1995

INVENTOR(S): Tommy M. Warren, Houston B. Mount

It is certified that error appears in the above-identified patent and that said Letters Patent is hereby corrected as shown below:

| Col. | Line | |
|---|---|---|
| 3 | 10 | "a plurality of cutting elements that are carded" should read --a plurality of cutting elements that are carried-- |
| 5 | 63-64 | "None of the various curve rates (short, medium, long) am inherently better than the others." should read --None of the various curve rates (short, medium, long) are inherently better than the others.-- |
| 8 | 1 | "the weight-on-bit lead" should read --the weight-on-bit load" |
| 8 | 4 | "The weight-on-bit lead" should read --The weight-on-bit load-- |
| 11 | 45-46 | "axial lead decreases" should read --axial load decreases" |

UNITED STATES PATENT AND TRADEMARK OFFICE
CERTIFICATE OF CORRECTION

PATENT NO.: 5,423,389

DATED: June 13, 1995

INVENTOR(S): Tommy M. Warren, Houston B. Mount

It is certified that error appears in the above-identified patent and that said Letters Patent is hereby corrected as shown below:

Patent reads:

| Col. | Line | |
|---|---|---|
| 11 | 49 | "axial lead transition" should read --axial load transition-- |
| 14 | 38-39 | "a pivotal center 292 which is generally coplariat," should read --a pivotal center 292 which is generally coplanar-- |
| 15 | 33-34 | "3 15/16 inch diameter drill bit." should read --3-15/16 inch diameter drill bit.-- |
| 16 | 61-62 | "Testing of 3 15/16 inch short radius curve drilling tools and an 8 1/2 inch long radius drilling tool" should read --Testing of 3-15/16 inch short radius curve drilling tools and an 8-1/2 inch long radius drilling tool-- |
| 19 | 43 | "the lateral forge on the drill bit" should read --the lateral force on the drill bit-- |

UNITED STATES PATENT AND TRADEMARK OFFICE
CERTIFICATE OF CORRECTION

PATENT NO.: 5,423,389

DATED: June 13, 1995

INVENTOR(S): Tommy M. Warren, Houston B. Mount

It is certified that error appears in the above-identified patent and that said Letters Patent is hereby corrected as shown below:

Patent reads:

| Col. | Line | |
|---|---|---|
| 20 | 33-34 | "predetermined axial distance from the rage of the drill bit" should read --predetermined axial distance from the face of the drill bit-- |

Signed and Sealed this

Third Day of October, 1995

*Attest:*

*Attesting Officer*

Bruce Lehman

BRUCE LEHMAN

*Commissioner of Patents and Trademarks*